US011761438B2

(12) United States Patent
Sun et al.

(10) Patent No.: US 11,761,438 B2
(45) Date of Patent: Sep. 19, 2023

(54) FLUID PUMPING DEVICE AND HORIZONTAL COMPRESSOR

(71) Applicant: EMERSON CLIMATE TECHNOLOGIES (SUZHOU) CO., LTD., Jiangsu (CN)

(72) Inventors: Qingfeng Sun, Suzhou (CN); Donghui Yang, Suzhou (CN)

(73) Assignee: Copeland Climate Technologies (Suzhou) Co. Ltd., Jiangsu (CN)

( * ) Notice: Subject to any disclaimer, the term of this patent is extended or adjusted under 35 U.S.C. 154(b) by 142 days.

(21) Appl. No.: 17/259,529

(22) PCT Filed: Jul. 9, 2019

(86) PCT No.: PCT/CN2019/095235
§ 371 (c)(1),
(2) Date: Jan. 11, 2021

(87) PCT Pub. No.: WO2020/011159
PCT Pub. Date: Jan. 16, 2020

(65) Prior Publication Data

US 2021/0164462 A1 Jun. 3, 2021

(30) Foreign Application Priority Data

Jul. 12, 2018 (CN) ..... 201810764848.X
Jul. 12, 2018 (CN) ..... 201821104439.9

(51) Int. Cl.
*F04C 15/06* (2006.01)
*F04C 2/10* (2006.01)
(Continued)

(52) U.S. Cl.
CPC ..... *F04B 39/0246* (2013.01); *F04B 39/0261* (2013.01)

(58) Field of Classification Search
CPC ..... F04C 2/102; F04C 2/086; F04C 15/06; F04C 14/04; F04C 2/10; F01M 1/02
See application file for complete search history.

(56) References Cited

U.S. PATENT DOCUMENTS 4,561,829 A 12/1985 Iwata et al.
5,322,420 A * 6/1994 Yannascoli ..... F04C 29/023 417/366
(Continued)

FOREIGN PATENT DOCUMENTS

CN 201206544 Y 3/2009
CN 102089526 A * 6/2011 ..... F04C 18/0215
(Continued)

OTHER PUBLICATIONS

English translation of DE102014222396 by PE2E, Jan. 17, 2023.*
(Continued)

*Primary Examiner* — Deming Wan
(74) *Attorney, Agent, or Firm* — Harness, Dickey & Pierce, P.L.C.

(57) ABSTRACT

Disclosed are a fluid pumping device and a horizontal compressor. The fluid pumping device comprises a pump structure in the form of an internal-meshing gear pump and is provided with first and second pump members, a pump housing structure for accommodating the pump structure, and at least two suction paths and/or at least two discharge paths. Suction and compression cavities are defined between the first and second pump members; the at least two suction paths are configured to rotate with the pump structure, and a fluid can be sucked into the suction cavity via the at least two suction paths respectively; and the at least two discharge paths are configured to rotate with the pump structure, and the compressed fluid can be discharged from the fluid pumping device via the discharge paths respectively. The
(Continued)

fluid pumping device is assembled in the horizontal compressor.

18 Claims, 12 Drawing Sheets

(51) Int. Cl.

| | |
|---|---|
| ***F04C 2/08*** | (2006.01) |
| ***F01M 1/02*** | (2006.01) |
| ***F04C 14/04*** | (2006.01) |
| ***F04B 39/02*** | (2006.01) |

(56) References Cited

U.S. PATENT DOCUMENTS

| | | | | |
|---|---|---|---|---|
| 2007/0071627 | A1 | 3/2007 | Lee et al. | |
| 2010/0122550 | A1* | 5/2010 | Cho | F04C 29/028 62/473 |
| 2015/0114790 | A1* | 4/2015 | Yamamori | F04C 14/24 137/565.13 |
| 2015/0267701 | A1 | 9/2015 | Pippes et al. | |
| 2017/0175741 | A1 | 6/2017 | Nishikawa | |
| 2019/0145414 | A1 | 5/2019 | Cui et al. | |

FOREIGN PATENT DOCUMENTS

| | | | | |
|---|---|---|---|---|
| CN | 202597099 | U | 12/2012 | |
| CN | 103291609 | A | 9/2013 | |
| CN | 105626514 | A | 6/2016 | |
| CN | 205578273 | U | 9/2016 | |
| CN | 208763848 | U | 4/2019 | |
| DE | 102014222396 | A1 * | 5/2016 | F04C 14/04 |
| EP | 2921703 | A2 | 9/2015 | |
| JP | H10148191 | A | 6/1998 | |
| WO | WO-2017-190651 | A1 | 11/2017 | |

OTHER PUBLICATIONS

English translation of CN-102089526 by PE2E Apr. 19, 2023.*
Extended European Search Report issued in corresponding application No. 19833215.7 dated Jun. 13, 2022.
International Search Report (in English and Chinese) and Written Opinion of the International Searching Authority (in Chinese) issued in PCT/CN2019/095235, dated Sep. 30, 2019; ISA/CN.

* cited by examiner

FLUID PUMPING DEVICE AND HORIZONTAL COMPRESSOR

CROSS-REFERENCE TO RELATED APPLICATIONS

This application is the national phase of International Aoolication No. PCT/CN2019/095235 titled "FLUID PUMPING DEVICE AND HORIZONTAL COMPRESSOR" and filed on Jul. 9, 2019, which claims the benefit of priorities to the following Chinese patent applications, which are incorporated herein by reference in their entireties:

(1) Chinese Patent Application No. 201810764848.X, titled "FLUID PUMPING DEVICE AND HORIZONTAL COMPRESSOR", filed with the China National Intellectual Property Administration on Jul. 12, 2018; and (2) Chinese Patent Application No. 201821104439.9, titled "FLUID PUMPING DEVICE AND HORIZONTAL COMPRESSOR", filed with the China National Intellectual Property Administration on Jul. 12, 2018.

FIELD

The present disclosure relates to a fluid pumping device and a horizontal compressor equipped with the fluid pumping device.

BACKGROUND

The contents of this section only provide background information related to the present disclosure, which may not necessarily constitute the prior art.

A compressor generally includes a housing, a compression mechanism housed in the housing, a motor that drives the compression mechanism, and a rotating shaft driven by the motor. During the operation of the compressor, it is generally necessary to provide lubricating oil to related moving components of the compressor (such as the compression mechanism) to ensure stable operation of the compressor. For a vertical compressor in which the rotating shaft is vertically arranged, an oil sump is generally provided on a bottom wall of the housing of the compressor, and an oil pumping mechanism is provided at the bottom of the rotating shaft. The oil pumping mechanism is configured to pump lubricating oil to the compression mechanism and related moving components through an oil supply passage provided in the rotating shaft. However, for a horizontal compressor, due to the substantially horizontal arrangement of the rotating shaft, unlike the vertical compressor, it is inconvenient to use an oil sump naturally formed at the bottom of the compressor, and an additional oil pumping mechanism is generally provided to pump lubricating oil to the compression mechanism and related moving components of the horizontal compressor.

Some oil supply solutions for horizontal compressors have already existed in the prior art. For example, a single oil pumping mechanism is provided to pump the lubricating oil stored in the oil reservoir in the high-pressure region to the rotating shaft, or a specialized oil sump is formed by means of a double-layer housing structure. However, the existing solutions still have some disadvantages in application. For example, under some working conditions (especially for variable-speed horizontal compressors), these solutions cannot provide lubricating oil or cannot provide enough lubricating oil, having a complicated structure and a high cost.

Therefore, there is a need to provide an improved oil pumping device.

SUMMARY

An object of the present disclosure is to provide an improved fluid pumping device and a horizontal compressor having the fluid pumping device to achieve at least one of the following advantages: simplifying the structure, reducing costs, improving the convenience of application, providing sufficient lubrication for the compression mechanism and related moving components, improving efficiency, improving the stability and reliability of operation of the compressor, etc.

According to an aspect of the present disclosure, a fluid pumping device is provided. The fluid pumping device includes: a pump structure including a first pump member and a second pump member which are configured to cooperate with each other, wherein the first pump member is arranged inside the second pump member; a pump housing structure defining a sealed pocket, wherein the pump structure can be rotatably assembled in the sealed pocket, so that a suction pocket and a compression pocket are defined between the first pump member and the second pump member; and at least two suction paths and/or at least two discharge paths, wherein the at least two suction paths are configured such that the fluid outside the fluid pumping device can be sucked into the suction pocket through the at least two suction paths as the pump structure rotates, and the at least two discharge paths are configured such that the compressed fluid in the compression pocket can be discharged from the fluid pumping device via the at least two discharge paths as the pump structure rotates.

Preferably, in the fluid pumping device, at least two suction pockets are defined between the first pump member and the second pump member, and the at least two suction paths communicate with respective suction pockets of the at least two suction pockets.

Preferably, in the fluid pumping device, at least two compression pockets are defined between the first pump member and the second pump member, and the at least two discharge paths communicate with respective compression pockets of the at least two compression pockets.

Preferably, in the fluid pumping device, the pump housing structure includes a pump housing having a first side surface and a second side surface opposite to each other, and a first recess is provided on the first side surface of the pump housing, and the pump structure is installed in the first recess.

Preferably, in the fluid pumping device, a second recess is provided on the first side surface of the pump housing and has a larger diameter than the first recess, so that a transition stepped portion is formed between the first recess and the second recess, and the pump housing structure further includes a sealing cover plate that is installed in the second recess and closely abuts against the transition stepped portion and the pump structure at the first side surface of the pump housing.

Preferably, in the fluid pumping device, the fluid pumping device has a first suction pocket and a second suction pocket formed between the first pump member and the second pump member, and the fluid pumping device includes a first suction path that is in fluid communication with the first suction pocket and a second suction path that is in fluid communication with the second suction pocket. The first suction path includes a first blind groove provided on a bottom wall of the first recess of the pump housing and a first through hole extending through part of the bottom wall of the first blind groove to the second side surface. The second suction path includes a second blind groove provided on the bottom wall of the first recess of the pump housing and a second through hole extending through part of the bottom wall of the second blind groove to the second side surface. In addition, the first blind groove and the second blind groove are sequentially arranged along a rotation direction of the pump structure on the bottom wall of the first recess, corresponding to the suction pocket of the pump structure.

Preferably, in the fluid pumping device, the fluid pumping device has a first compression pocket and a second compression pocket formed between the first pump member and the second pump member, and the fluid pumping device includes a first discharge path that is in fluid communication with the first compression pocket and a second discharge path that is in fluid communication with the second compression pocket. The first discharge path includes a third blind groove provided on the bottom wall of the first recess of the pump housing and a third through hole extending through part of the bottom wall of the third blind groove to the second side surface. The second discharge path includes a fourth blind groove provided on the bottom wall of the first recess of the pump housing and a radial groove that extends radially from the fourth blind groove toward the center of the first recess and is in fluid communication with the fourth blind groove. In addition, the third blind groove and the fourth blind groove are sequentially arranged along the rotation direction of the pump structure on the bottom wall of the first recess, corresponding to the compression pocket of the pump structure.

Preferably, in the fluid pumping device, the first blind groove, the second blind groove, the third blind groove and the fourth blind groove are four arc-shaped grooves extending on a same circle on the bottom wall of the first recess of the pump housing.

Preferably, in the fluid pumping device, the first blind groove, the second blind groove, the third blind groove and the fourth blind groove have the same length and are arranged symmetrically with respect to the center of the first recess; or, the lengths of the first blind groove, the second blind groove, the third blind groove and the fourth blind groove are different, and/or two adjacent blind grooves of the first blind groove, the second blind groove, the third blind groove and the fourth blind groove are spaced apart by the same or different distances.

Preferably, in the fluid pumping device, a suction side groove is formed on the bottom wall of the first recess of the pump housing, corresponding to the first suction pocket and the second suction pocket of the pump structure; and a first partition assembly is provided in the suction side groove to partition the suction side groove into the first blind groove and the second blind groove. The first partition assembly is configured to adjust relative extension lengths of the first blind groove and the second blind groove by changing a position of the first partition assembly in the suction side groove.

Preferably, in the fluid pumping device, the first partition assembly includes two or more first engaging protrusions arranged in the suction side groove, and a first engaging block which is fixedly connected with the first engaging protrusions in a snap-fitting manner to partition the suction side groove into the first blind groove and the second blind groove.

Preferably, in the fluid pumping device, a discharge side groove is formed on the bottom wall of the first recess of the pump housing, corresponding to the first compression pocket and the second compression pocket of the pump structure; and a second partition assembly is provided in the discharge side groove to partition the discharge side groove into the third blind groove and the fourth blind groove. The second partition assembly is configured to adjust relative extension lengths of the third blind groove and the fourth blind groove by changing a position of the second partition assembly in the discharge side groove.

Preferably, in the fluid pumping device, the second partition assembly includes two or more second engaging protrusions arranged in the discharge side groove, and a second engaging block which is fixedly connected with the second engaging protrusions in a snap-fitting manner to partition the discharge side groove into the third blind groove and the fourth blind groove.

Preferably, in the fluid pumping device, a first pipe connecting portion is formed on and protrudes from the second side surface of the pump housing at a position corresponding to the first through hole, and the first through hole further penetrates through the first pipe connecting portion; and/or, a second pipe connecting portion is formed on and protrudes from the second side surface of the pump housing at a position corresponding to the second through hole, and the second through hole further penetrates through the second pipe connecting portion; and/or, a third pipe connecting portion is formed on and protrudes from the second side surface of the pump housing at a position corresponding to the third through hole, and the third through hole further penetrates through the third pipe connecting portion.

Preferably, in the fluid pumping device, the pump structure is implemented as an inner-meshing gear pump and includes an internal gear member as the first pump member and an external gear member as the second pump member.

According to another aspect of the present disclosure, a horizontal compressor is provided. The horizontal compressor includes: a housing which is partitioned into a motor region including a motor and an oil storage region for storing lubricating oil; a rotating shaft which is arranged in the housing and driven by the motor, wherein an oil supply passage is provided in the rotating shaft and extends through the rotating shaft; a compression mechanism which is arranged at a first end of the rotating shaft in the motor region, wherein lubricating oil can be supplied to the compression mechanism through the oil supply passage of the rotating shaft; and the fluid pumping device as described above.

Preferably, in the horizontal compressor, the fluid pumping device is installed at a second end of the rotating shaft in the oil storage region, and is configured to suck lubricating oil from the oil storage region and the motor region through the first suction path and the second suction path of the at least two suction paths, and is configured to pump the compressed lubricating oil to the oil storage region and the oil supply passage of the rotating shaft through the first discharge path and the second discharge path of the at least two discharge paths.

Preferably, in the horizontal compressor, it further includes a first fluid supply pipe capable of guiding the lubricating oil in the oil storage region to the first suction path and a second fluid supply pipe capable of guiding the lubricating oil in the motor region to the second suction path.

Preferably, in the horizontal compressor, the first pump member of the fluid pumping device is fixedly sleeved on the second end of the rotating shaft, so that the radial groove in the first recess of the pump housing of the pump housing structure is aligned with the oil supply passage of the rotating shaft.

Preferably, the horizontal compressor further includes: a partition plate which is fixed to the housing in the housing and divides the inside of the housing into the motor region and the oil storage region; and a rear end bearing housing, wherein the partition plate is sleeved on the rear end bearing housing, and the rear end bearing housing is configured to support the second end of the rotating shaft, and the pump housing of the fluid pumping device is fixedly connected to the rear end bearing housing.

According to the present disclosure, two or more ways of suction and/or two or more ways of discharge of fluid (for example, lubricating oil) can be realized by the structural design of the single fluid pumping device. In particular, in a case that at least two suction paths and at least two discharge paths are provided, multi-way suction and multi-way discharge of fluid can be realized. This arrangement simplifies the structure and reduces the cost. Preferably, the first suction pocket along the rotation direction of the pump structure is communicated to the oil storage region, so that lubricating oil can be preferentially sucked from the oil storage region after the compressor is started. The provision of the additional suction pocket communicated to the motor region can avoid damage to related components caused by the inability to suck enough lubricating oil from the oil storage region, can improve the stability of operation of the compressor and is conducive to the virtuous cycle of lubricating oil. In addition, the first compression pocket along the rotation direction of the pump structure is communicated to the oil storage region, which helps to preferentially discharge the gas that may be sucked into the suction pocket to the oil storage region, and can avoid the gas from being discharged into the rotating shaft. The reliability and stability of the operation of the fluid pumping device and the compressor can thus be improved. In addition, the structural configuration of the elongated groove and the position adjustable partition assembly arranged therein makes it possible to adjust the suction volume and discharge volume of the pump structure according to actual application requirements, thereby improving the applicability and flexibility of the fluid pumping device according to the present disclosure.

BRIEF DESCRIPTION OF THE DRAWINGS

The features and advantages of one or more embodiments of the present disclosure will become more readily understood from the following description with reference to the accompanying drawings. The drawings described herein are for illustration only and are not intended to limit the scope of the present disclosure in any way. The drawings are not drawn to scale, and some features may be enlarged or minified or viewed from different angles to show the details of a particular member. In the drawings.

DETAILED DESCRIPTION OF THE EMBODIMENTS

Figure 1:
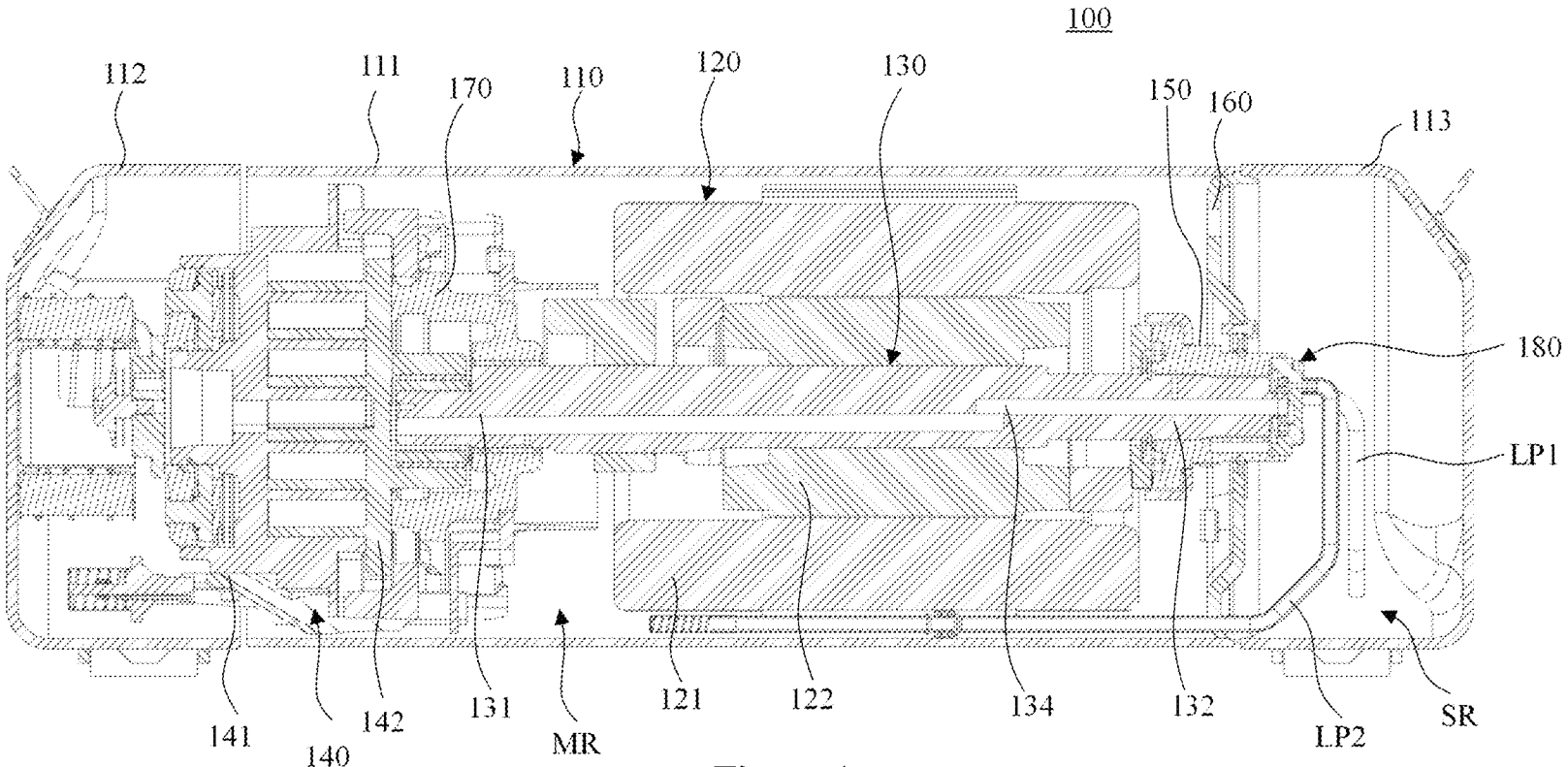
FIG. 1 is a longitudinal sectional view of a horizontal compressor according to an embodiment of the present disclosure.

The following description of various embodiments of the present disclosure is only illustrative and is by no means intended to limit the present disclosure and the application or usage thereof. The same reference numerals are used in the figures to indicate the same components, and thus the configurations of the same components will not be repeatedly described.

In the present disclosure, for the convenience of description, the fluid pumping device according to the present disclosure will be described by an example of use in a horizontal compressor. However, it is conceivable that, the fluid pumping device according to the present disclosure is not limited to the application in the compressor, but can be used in any feasible application that requires to provide fluid (for example, lubricating oil) to related components.

First, the basic structure of a horizontal compressor 100 having a fluid pumping device 180 according to the present disclosure is briefly described with reference to FIG. 1.

As shown in FIG. 1, the horizontal compressor 100 may generally include a housing 110, a motor 120, a rotating shaft 130 driven by the motor 120, and a compression mechanism 140 arranged at one end of the rotating shaft 130 (herein, for convenience of description, referred to as a first end), and a rear end bearing housing 150 configured to support the rotating shaft 130 at another end of the rotating shaft 130 (referred to as a second end herein).

The housing 110 includes a housing body 111, and a first end cover 112 and a second end cover 113 which are respectively provided at two ends of the housing body 111. The motor 120, the rotating shaft 130, the compression mechanism 140, and the rear end bearing housing 150 may all be arranged inside the housing 110. The motor 120 may include a stator 121 fixed to the housing body 111 and a rotor 122 arranged inside the stator 121. The rotating shaft 130 extends substantially in a horizontal direction. The rotating shaft 130 is driven by the motor 120. The rotating shaft 130 may be fixed to the rotor 122 so as to rotate with the rotation of the rotor 122. The first end 131 of the rotating shaft 130 may be supported by the main bearing housing 170, and the second end 132 of the rotating shaft 130 opposite to the first end 131 may be supported by the rear end bearing housing 150.

The compression mechanism 140 may be driven by the rotating shaft 130 to compress the working fluid (for example, the refrigerant) introduced into the compression mechanism 140. The compression mechanism 140 may include a non-orbiting scroll member 141 and an orbiting scroll member 142 which meshedly engage with each other. With the operation of the compression mechanism 140, a series of compression pockets are formed between the non-orbiting scroll member 141 and the orbiting scroll member 142 so as to compress the working fluid sucked into these compression pockets. In this embodiment, the compression mechanism 140 adopts a scroll structure. However, it is conceivable that, the compression mechanism may adopt other feasible structures, and is not limited to the structure in this embodiment.

In order to enable the compressor to operate stably, it is generally required to provide lubricating oil to the relevant moving components of the compressor (for example, the compression mechanism, the contact portions of the rotating shaft and the corresponding bearing housing, or the like). In the prior art, an oil supply passage is generally provided inside the rotating shaft and extends through the rotating shaft in a longitudinal direction of the rotating shaft, so that lubricating oil is pumped in from the second end of the rotating shaft and supplied to the compression mechanism arranged at the first end of the rotating shaft through the oil supply passage. In addition, a branch oil supply path in fluid communication with the oil supply passage may be provided in the rotating shaft, so as to further distribute the lubricating oil introduced into the oil supply passage to other moving components to be lubricated. The oil supply passage in the rotating shaft generally includes a concentric hole (the portion indicated by 134 in FIG. 1) arranged concentrically with the rotating shaft and an eccentric hole (not shown) communicating with the concentric hole and offset relative to an axis of rotation of the rotating shaft.

Generally, an additional oil pumping mechanism is provided to auxiliary pump the lubricating oil into the oil supply passage. For the horizontal compressor, since the rotating shaft thereof is generally arranged horizontally, it is not convenient for the horizontal compressor to use the "natural" oil sump accumulated at the bottom (that is, the second end of the rotating shaft) of the compressor like a vertical compressor. Therefore, compared with the vertical compressor, the structure of the oil pumping mechanism of the horizontal compressor needs consideration of more factors. In the prior art, there is a design idea of using the pressure difference between the high-pressure side and the low-pressure side of the compressor to pump the lubricating oil accumulated on the high-pressure side into the low-pressure side, or there is a structural design of shell-in-shell (that is, an additional oil storage tank is provided in the compressor). The existing oil pumping mechanism has played a very good role in enhancing the operational reliability and stability of the horizontal compressor. However, there still are some requirements on improvement in the application. The present disclosure is intended to provide an improved fluid pumping device and a horizontal compressor to achieve at least one of the following objects: simplifying the structure, reducing costs, improving the convenience of application, providing sufficient lubrication for the compression mechanism and related moving components, improving efficiency, improving the stability and reliability of operation of the compressor, or the like. In particular, for a variable speed horizontal compressor, by adopting the fluid pumping device according to the present disclosure, the operating stability and reliability of the horizontal compressor can be greatly improved.

The fluid pumping device 180 according to the present disclosure and its application in the horizontal compressor 100 are described in detail below with reference to FIGS. 1 to 16B.

As shown in FIG. 1, a partition plate 160 may be provided at a position close to the second end 132 of the rotating shaft 130 in the horizontal compressor 100. The partition plate 160 may be provided such as to partition the inside of the housing 110 into a motor region MR where the motor 120 is provided and an oil storage region SR where lubricating oil is stored. It is conceivable that, for a low-pressure side horizontal compressor with the motor 120 arranged on the low-pressure side, both the motor region MR and the oil storage region SR may be located on the low-pressure side of the horizontal compressor.

The rear end bearing housing 150 supporting the rotating shaft 130 may extend through a central region of the partition plate 160, so that the partition plate 160 can be sleeved on the rear end bearing housing 150. The outer periphery of the partition plate 160 may be fixedly connected to the housing 110 (for example, be welded at a connection region of the housing body 111 and the second end cover 113). The partition plate 160 may adopt an existing feasible structure. Therefore, the structure of the partition plate 160 is not described in detail and limited in the present disclosure.

Figure 2:
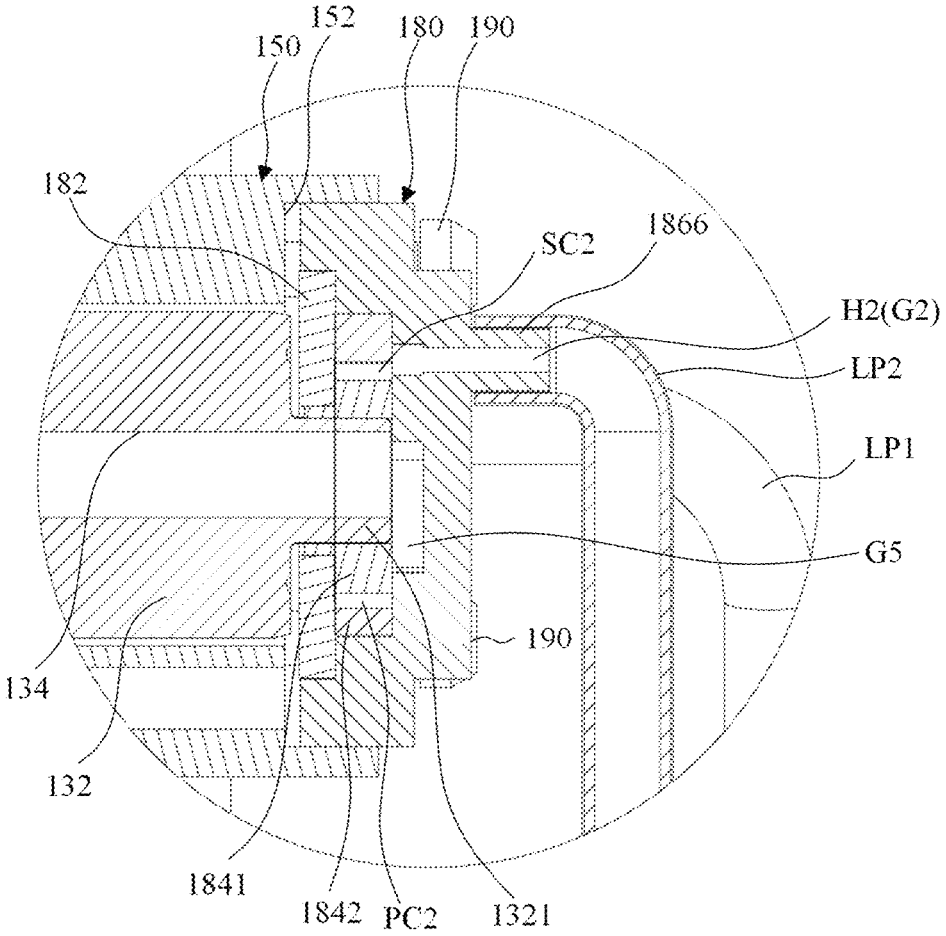
FIG. 2 is a partially enlarged view of the horizontal compressor shown in FIG. 1.
Figure 3:
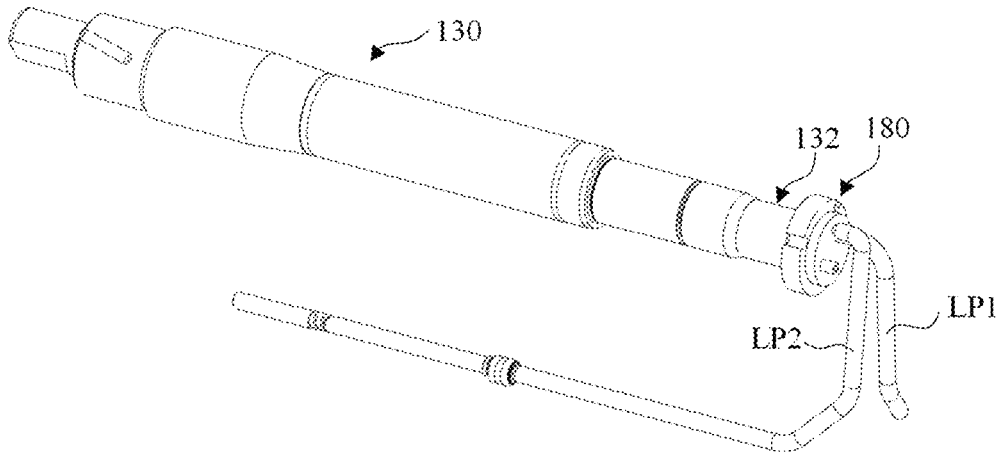
FIG. 3 is a schematic view showing an assembly of a fluid pumping device and a rotating shaft according to an embodiment of the present disclosure.

The fluid pumping device 180 according to the present disclosure (in the present disclosure, the fluid may be lubricating oil) may be installed at the second end 132 of the rotating shaft 130, and may be fixedly connected to the rear end bearing housing 150 by a fastening device such as a screw 190. FIG. 2 is a partially enlarged view of the horizontal compressor shown in FIG. 1, which shows the connection details among the fluid pumping device 180 according to the present disclosure, the second end 132 of the rotating shaft 130 and the rear end bearing housing 150. For the assembly relationship between the fluid pumping device 180 and the rotating shaft 130, reference may be made to FIGS. 3 and 4. More details on the assembly among the fluid pumping device 180, the rotating shaft 130 and the rear end bearing housing 150 will be further described below.

Figure 5:
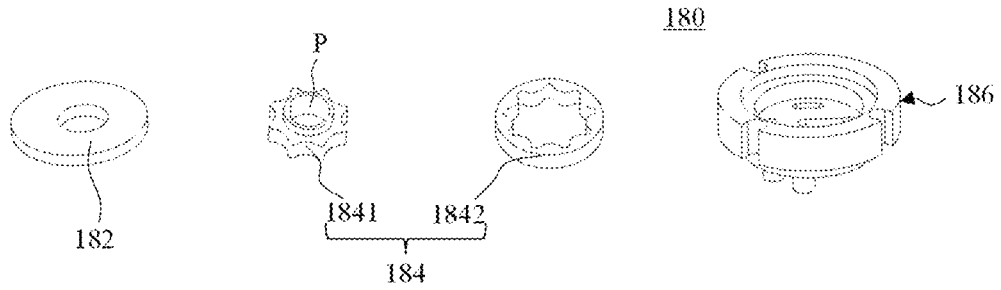
FIG. 5 is an exploded view of the fluid pumping device according to an embodiment of the present disclosure.
Figure 6:
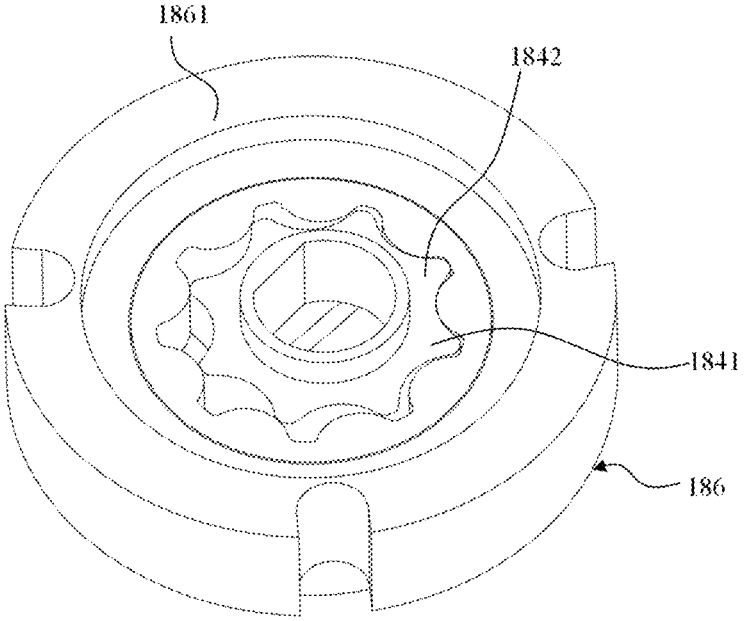
FIG. 6 is a schematic perspective view showing part of the fluid pumping device shown in FIG. 5, where a sealing cover plate is removed so as to clearly see how a pump structure is installed in a pump housing.
Figure 7:
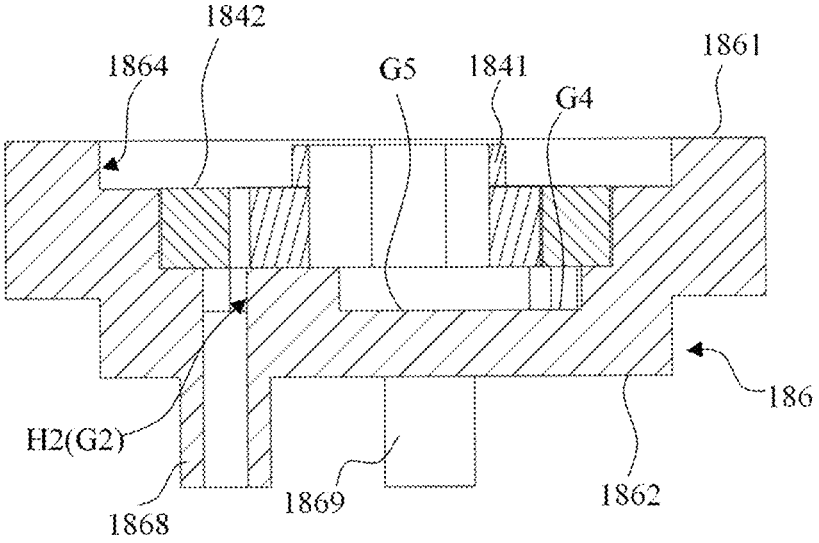
FIG. 7 is a schematic view of the pump housing and the pump structure according to an embodiment of the present disclosure.

FIG. 5 is an exploded view of the fluid pumping device 180 according to an embodiment of the present disclosure. As shown in FIG. 5, the fluid pumping device 180 according to the present disclosure may include a pump structure 184 and a pump housing structure. The pump structure includes a first gear member 1841 (internal gear member which corresponds to the first pump member according to the present disclosure) and a second gear member 1842 (external gear member which corresponds to the second pump member according to the present disclosure). A sealed pocket for accommodating the pump structure 184 may be defined in the pump housing structure. The pump structure 184 may be rotatably installed in the sealed pocket, so that multiple pockets can be defined between the first gear member 1841 and the second gear member 1842 by the pump housing structure, the first gear member 1841 and the second gear member 1842. Here, it should be noted that, although an inner-meshing gear pump is used as an example to describe the present disclosure, it should be understood that the concept of the present disclosure is not limited to the inner-meshing gear pump but can be applied to other suitable pump structures. For example, in a sliding vane pump (that is, a pump structure that includes a fixed cylinder, a rotor arranged in the cylinder, and sliding vanes that partition several pockets including a suction pocket and a compression discharge pocket), at least two suction paths and/or at least two discharge paths may be provided for a single pump mechanism. In this case, the cylinder corresponds to the second pump member according to the present disclosure, and the rotor corresponds to the first pump member according to the present disclosure.

According to exemplary embodiments of the present disclosure, the pump housing structure may include a pump housing 186 and a sealing cover plate 182. With reference to FIG. 2, the pump housing 186 and the sealing cover plate 182 may jointly define the sealed pocket for accommodating the pump structure 184 as described above.

The first gear member 1841 and the second gear member 1842 of the pump structure 184 may cooperate with each other in the form of a known inner-meshing gear pump. The first gear member 1841 may be installed in the second gear member 1842 so as to cooperate with the second gear member 1842. That is, the first gear member 1841 may be configured as a driving gear, which is rotatable under the driving force from another member (for example, the rotating shaft 130 of the horizontal compressor). The second gear member 1842 may be configured as a driven gear, which is able to rotate with the rotation of the first gear member 1841 under the drive of the first gear member 1841. For example, in the exemplary embodiment shown in FIGS. 1 to 4, the first gear member 1841 may be assembled onto the second end 132 of the rotating shaft 130, so that the first gear member 1841 is actuated by the rotating shaft 130. The rotation of the first gear member 1841 can further drive the second gear member 1842 to rotate.

It can be understood that, for specific applications, the first gear member 1841 may be eccentrically arranged with respect to the second gear member 1842, so that the external teeth of the first gear member 1841 and the internal teeth of the second gear member 1842 can meshedly engage with each other. After the pump structure 184 is actuated and operates normally, the multiple pockets defined between the first gear member 1841 and the second gear member 1842 may include suction pockets on the suction side (that is, pockets that have gradually increasing volumes and suck fluid in as the pump structure 184 rotates) and compression pockets on the compression side (that is, pockets that have gradually reducing volumes and compress the fluid therein as the pump structure 184 rotates). The first gear member 1841 and the second gear member 1842 may be appropriately configured so that, as the pump structure 184 operates, one or more suction pockets and/or one or more compression pockets can be formed between the first gear member 1841 and the second gear member 1842 (reference can be made to FIGS. 10A to 10C).

The fluid pumping device 180 according to the present disclosure may be provided with at least two suction paths, so as to suck the fluid outside the fluid pumping device 180 into the suction pockets via the at least two suction paths and compress the sucked fluid following the rotation of the pump structure 184. This structural arrangement enables the fluid pumping device to have a two-way suction capability, so that fluid can be sucked from different fluid sources. The fluid pumping device 180 may further be provided with a discharge path so that the compressed fluid in the compression pocket can be discharged from the fluid pumping device via the discharge path. For example, the fluid pumping device may have only one discharge path, so that the compressed fluid can be discharged through this discharge path. The fluid pumping device may have two or more discharge paths, so that the compressed fluid can be pumped to different downstream components. In addition, it is conceivable that, in the fluid pumping device according to the present disclosure, in a case that one or more suction paths are provided, at least two discharge paths (such as two paths) may be provided, so as to supply the lubricating oil sucked from, for example, only one suction path (for example, from the oil sump) to different parts (for example, the oil supply passage of the rotating shaft and another oil supply passage that can supply lubricating oil to the rear end bearing) requiring lubricating oil through the at least two discharge paths.

According to an embodiment of the present disclosure, at least two suction pockets may be defined between the first gear member 1841 and the second gear member 1842, and the at least two suction paths are configured to communicate with the corresponding one of the at least two suction pockets (that is, each suction path is communicated to a different suction pocket). Therefore, the fluid sucked through the two suction paths can be compressed by more than two suction pockets.

According to an embodiment of the present disclosure, the aforementioned discharge path may include at least two discharge paths. The at least two discharge paths may be configured such that the compressed fluid in the compression pocket can be discharged from the fluid pumping device via the at least two discharge paths. As a result, the compressed fluid can be supplied to different downstream components.

According to an embodiment of the present disclosure, at least two compression pockets may be defined between the first gear member 1841 and the second gear member 1842, and the at least two discharge paths are configured to communicate with the corresponding one of the at least two compression pockets (that is, each discharge path is communicated to a different compression pocket). Therefore, the fluid can be compressed in the at least two compression pockets.

According to the present disclosure, the relationship between the number of suction paths and the number of suction pockets may be varied. For example, the number of suction paths is more than the number of suction pockets (in this case, for example, two suction paths may be communicated to a same suction pocket), or the number of suction paths is equal to the number of suction pockets (in this case, for example, each suction path is communicated to a different suction pocket, that is, in a one-to-one correspondence), or the number of suction paths is less than the number of suction pockets (in this case, for example, there is at least one suction pocket that does not communicate with all the suction paths). The same is also applied to the relationship between the number of discharge paths and the number of compression pockets.

As mentioned above, the pump structure 184 of the present disclosure works in a conventionally known manner. For those skilled in the art, the pump structure 184 described in the present disclosure can be easily realized according to the description of the present disclosure and in combination with actual needs. Therefore, the structural arrangement of the first gear member 1841 and the second gear member 1842 will not be described in detail in this disclosure.

As shown in FIGS. 2, 5, 7, 8 and 9, the sealing cover plate 182 may be a flat plate member. The pump housing 186 according to the present disclosure may have a first side surface 1861 and a second side surface 1862 opposite to each other. A first recess 1863 may be formed on the first side surface 1861 of the pump housing 186. The pump structure 184 may be integrally installed in the first recess 1863. It can be understood that the first recess 1863 may be configured such that the second gear member 1842 of the pump structure 184 is rotatably installed in the first recess, that is, the depth of the first recess 1863 may be substantially equal to the thickness of the second gear member 1842, and the diameter of the first recess 1863 may be slightly larger than the outer diameter of the second gear member 1842. The sealing cover plate 182 may be arranged on the first side surface 1861 of the pump housing 186, so as to define a sealed pocket for accommodating the pump structure 184 together with the pump housing 186.

Figure 9:
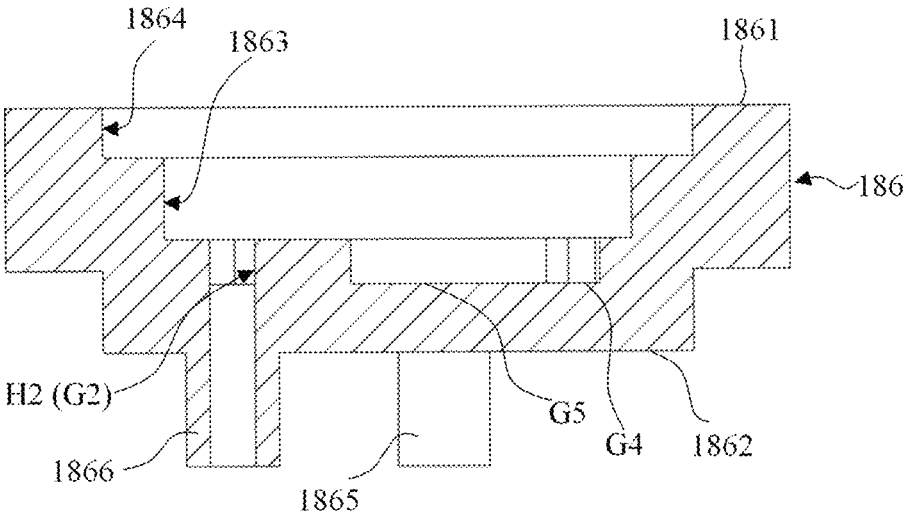
FIG. 9 is a schematic sectional view of the pump housing shown in FIG. 8.
Figure 10A:
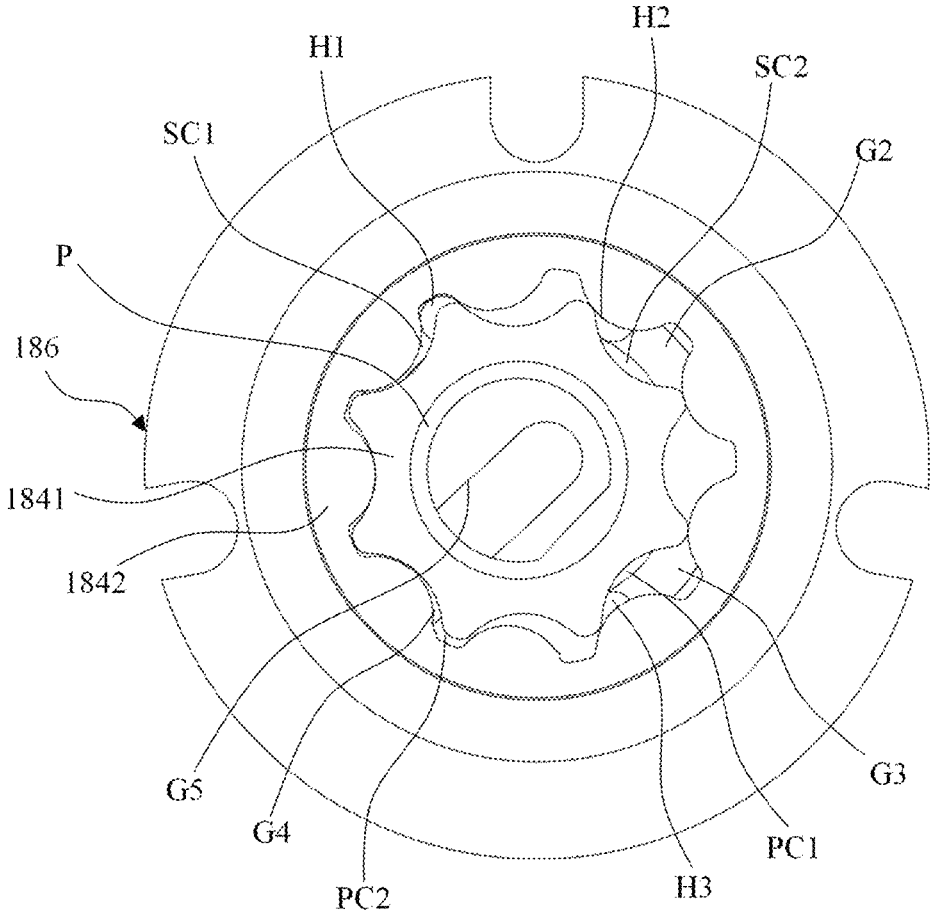
FIGS. 10A, 10B, and 10C show the relative positional relationship between an internal gear member and an external gear member at different moments during the operation of the pump structure according to an embodiment of the present disclosure.
Figure 10B:
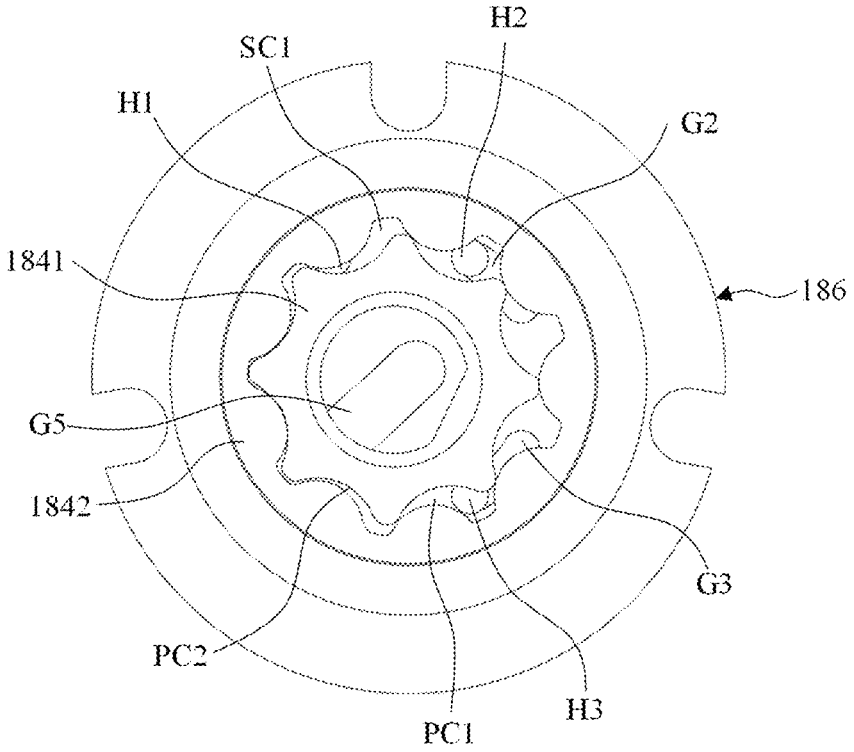
Figure 10C:
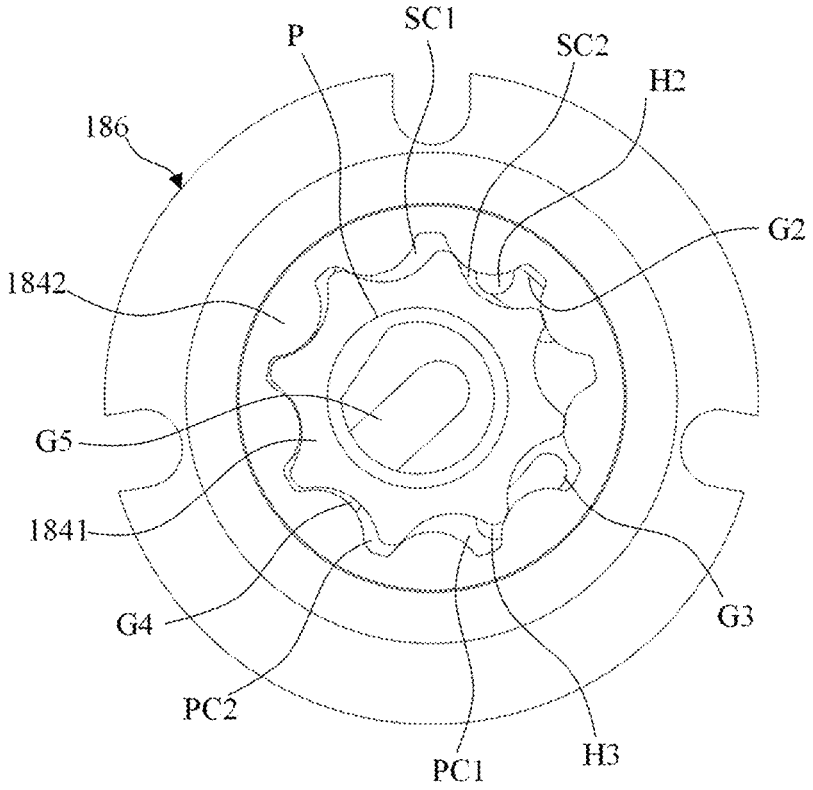

As shown in FIGS. 2 and 9, in an embodiment according to the present disclosure, a second recess 1864 may be provided on the first side surface 1861 of the pump housing 186. The diameter of the second recess 1864 may be greater than the diameter of the first recess 1863, so that a transition stepped portion may be formed between the first recess 1863 and the second recess 1864. The sealing cover plate 182 may be installed into the second recess 1864, being closely attached to the transition stepped portion, so that the first recess 1863 defines the aforementioned sealed pocket. Optionally, after the fluid pumping device according to the present disclosure is applied, the sealing cover plate 182 is fixedly connected to the pump housing 186 by means of the structure in the specific application. For example, in the application of the horizontal compressor 100 according to the present disclosure as shown in FIGS. 1 and 2, as described below, the fixed connection between the sealing cover plate 182 and the pump housing 184 can be achieved by means of the rear end bearing housing 150.

Optionally, in an embodiment that is not shown, the sealing cover plate may be fixedly connected to the pump housing by means of another connecting member. For example, the sealing cover plate may have a large diameter portion and a small diameter portion, the large diameter portion may abut against the first side surface 1861 of the pump housing 186, and the small diameter portion may be installed in the second recess 1864, and the sealing cover plate 182 can be directly fixedly connected to the pump housing 186 by a fixed connection structure such as a screw or a snap-fit structure.

It can be understood that the pump housing structure may have a structure different from the sealing cover plate and the pump housing, and the configurations of the sealing cover plate 182 and the pump housing 186 are not limited to those described and shown in the present disclosure. The configuration of the relevant structure can be appropriately modified according to the structure of the specific application to which the fluid pumping device is applied.

Figure 4:
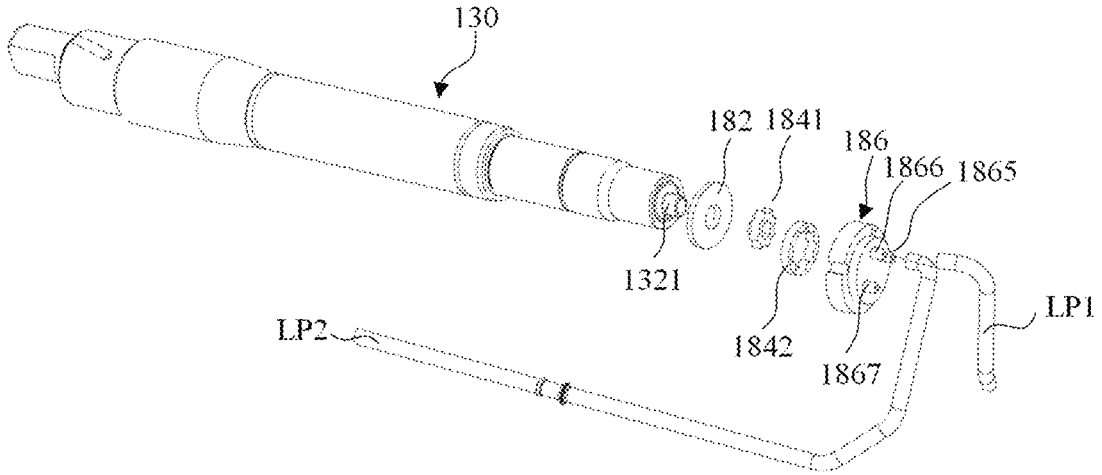
FIG. 4 is an exploded view of the fluid pumping device and the rotating shaft shown in FIG. 3.

As mentioned above, the fluid pumping device 180 of the present disclosure may be installed on the rear end bearing housing 150 and the second end 132 of the rotating shaft 130 of the horizontal compressor 100. According to an exemplary embodiment of the present disclosure, as shown in FIGS. 4 and 5, the second end 132 of the rotating shaft 130 may have a D-shaped section end 1321, and the inner peripheral surface of the first gear member 1841 may have a D-shaped section that matches the D-shaped section end 1321 of the rotating shaft 130. In this way, the first gear member 1841 may be assembled (for example, press-fitted) on the D-shaped section end 1321 of the rotating shaft 130 in a shape-matching manner. Preferably, the first gear member 1841 may include a flange portion P, so that an engagement area between the first gear member 1841 and the second end 132 of the rotating shaft 130 can be increased, and the connection between the two is more stable. When the first gear member 1841 is assembled into the second gear member 1842, the flange portion P may protrude from the second gear member 1842. Optionally, the first gear member 1841 may also be fixedly assembled at the second end 132 of the rotating shaft 130 in another detachable manner.

A receiving groove 152 may be provided on a side of the rear end bearing housing 150 facing away from the motor 120. After the sealing cover plate 182 and the pump structure 184 (especially the first gear member 1841) are installed on the D-shaped section end 1321 of the rotating shaft 130 (the sealing cover plate 182 may be sleeved on the flange portion P of the first gear member 1841), the pump housing 186 can be inserted into the receiving groove 152 of the rear end bearing housing 150. Then, the pump housing 186 can be fixedly connected in the receiving groove 152 by a fastening device such as a screw 190.

As mentioned above, the fluid pumping device according to the present disclosure may include at least two suction pockets, at least two compression pockets, at least two suction paths, and at least two discharge paths. The at least two suction paths may correspond to the at least two suction pockets, and the at least two discharge paths may correspond to the at least two compression pockets. In other words, each suction path may be configured such that, after the fluid pumping device is activated (or after the first gear member 1841 is actuated), as the pump structure 184 rotates, the fluid from the outside of the fluid pumping device 180 (for example, a pipe connected to the fluid pumping device 180) can be sucked into the corresponding suction pocket via the suction path, so as to compress the fluid during the subsequent rotation of the pump structure 184. Each discharge path may be configured to discharge the compressed fluid in the corresponding compression pocket from the fluid pumping device 180 (for example, as described below, discharge the fluid to the oil storage region SR of the horizontal compressor 100 or pump the fluid to the rotating shaft 130).

Preferably, the at least two suction paths may be configured such that each suction path corresponds to a single suction pocket at every moment during the rotation of the pump structure 184 (in particular, the suction paths are not communicated to each other), so that the fluid can be sucked into the corresponding suction pocket through each suction path. In other words, the number of suction paths may correspond to the number of suction pockets, so that each suction path corresponds to a suction pocket at every moment during the rotation of the pump structure 184, and the outside fluid can be sucked into the corresponding suction pocket.

Similarly, preferably, the at least two discharge paths may be configured such that each discharge path corresponds to a same compression pocket at every moment during the rotation of the pump structure 184 (in particular, the discharge paths are not communicated to each other), so that the compressed fluid in the corresponding compression pocket can be discharged through each discharge path. In other words, the number of discharge paths may correspond to the number of compression pockets, so that the compression paths correspond to the respective compression pockets at every moment during the rotation of the pump structure 184, and the compressed fluid in the corresponding compression pocket can be discharged.

In the following, for ease of description, the fluid pumping device according to the present disclosure is described in detail by taking the fluid pumping device including two suction pockets, two compression pockets, two suction paths, and two discharge paths as an example. However, it can be understood that, according to the needs of specific applications, more than two suction pockets and compression pockets can be formed between the first gear member 1841 and the second gear member 1842 by appropriately configuring the first gear member 1841 and the second gear member 1842, and more than two suction paths and more than two discharge paths may be accordingly provided, for example, a configuration including three suction pockets, three compression pockets, three suction paths, and three discharge paths, or a configuration including four suction pockets, four compression pockets, four suction paths, and four discharge paths.

Figure 8:
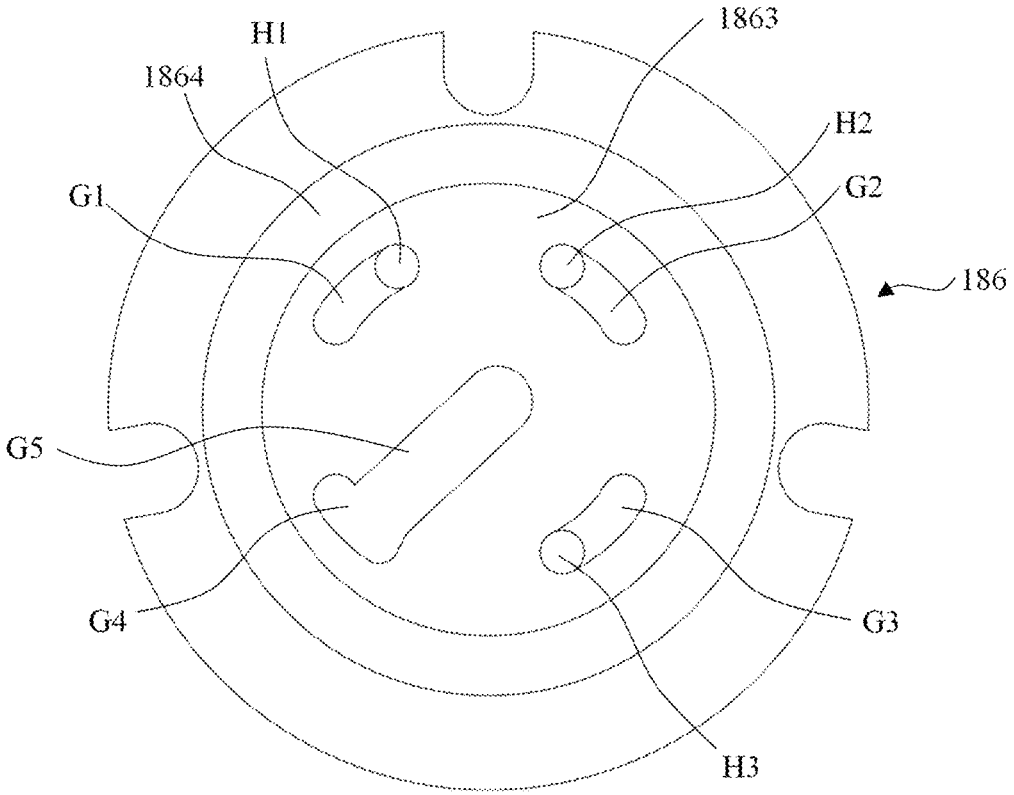
FIG. 8 is a schematic top view of the pump housing according to an embodiment of the present disclosure.

According to an embodiment of the present disclosure, the fluid pumping device 180 may include two suction paths, that is, a first suction path and a second suction path. As shown in FIGS. 8 and 9, a first blind groove G1 and a second blind groove G2 that are spaced apart from each other may be provided on a bottom wall of a first recess 1863 of the pump housing 186. Moreover, a first through hole H1 may be provided in the first blind groove G1, and a second through hole H2 may be provided in the second blind groove G2. The first through hole H1 may occupy only a part of the bottom wall of the first blind groove G1. Similarly, the second through hole H2 may occupy only a part of the bottom wall of the second blind groove G2. Therefore, the first suction path may be formed of the first blind groove G1 and the first through hole H1, and the second suction path may be formed of the second blind groove G2 and the second through hole H2.

It can be understood that the first suction path and the second suction path may be arranged on a side of the pump structure 184 where the suction pocket is formed. That is, the first blind groove G1 and the second blind groove G2 may be provided on a side of the bottom wall of the first recess 1863 of the pump housing 186 corresponding to the suction pocket of the pump structure 184. The first blind groove G1 and the second blind groove G2 may be sequentially arranged along a rotation direction of the pump structure 184. For example, in the view shown in FIG. 8, assuming that the pump structure 184 rotates clockwise, the first blind groove G1 and the second blind groove G2 may be sequentially arranged in a clockwise direction. In the embodiment shown in FIG. 8, the first through hole H1 is arranged at one end of the first blind groove G1 close to the second blind groove G2, and the second through hole H2 is arranged at one end of the second blind groove G2 close to the first blind groove G1. It can be understood that the position of the first through hole H1 in the first blind hole G1 and the position of the second through hole H2 in the second blind groove G2 can be comprehensively determined in combination with the structural configuration of the first gear member 1841 and the second gear member 1842, as well as the fluid suction volume and discharge volume required by specific applications, and are not limited by the present disclosure.

The fluid pumping device 180 may further include two discharge paths, that is, a first discharge path and a second discharge path. Further referring to FIGS. 8 and 9, a third blind groove G3 and a fourth blind groove G4 that are spaced apart from each other may be provided on the bottom wall of the first recess 1863 of the pump housing 186. Moreover, a third through hole H3 may be provided in the third blind groove G3. Similarly, the third through hole H3 may occupy only a part of the bottom wall of the third blind groove G3. Moreover, a radial groove G5 extending radially from the center of the first recess 1863 toward the fourth blind groove G4 and fluidly communicating with the fourth blind groove G4 may be provided on the bottom wall of the first recess 1863. Therefore, the first discharge path may be formed of the third blind groove G3 and the third through hole H3, and the second discharge path may be formed of the fourth blind groove G4 and the radial groove G5. Similarly, although in the embodiment shown in FIG. 8, the third through hole H3 is provided at one end of the third blind groove G3 close to the fourth blind groove G4, the position of the third through hole H3 in the third blind groove G3 is not limited by the present disclosure.

It can be understood that the first discharge path and the second discharge path may be arranged on a side of the pump structure 184 where the compression pocket is formed. That is, the third blind groove G3 and the fourth blind groove G4 may be provided on a side of the bottom wall of the first recess 1863 of the pump housing 186 corresponding to the compression pocket of the pump structure 184. The third blind groove G3 and the fourth blind groove G4 may be sequentially arranged along the rotation direction of the pump structure 184. For example, in the view shown in FIG. 8, assuming that the pump structure 184 rotates clockwise, the third blind groove G3 and the fourth blind groove G4 may be sequentially arranged in the clockwise direction, that is, from the view shown in FIG. 8, the third blind groove G3 and the fourth blind groove G4 may be sequentially arranged in a clockwise direction at the downstream of the second blind groove G2.

Figure 11:
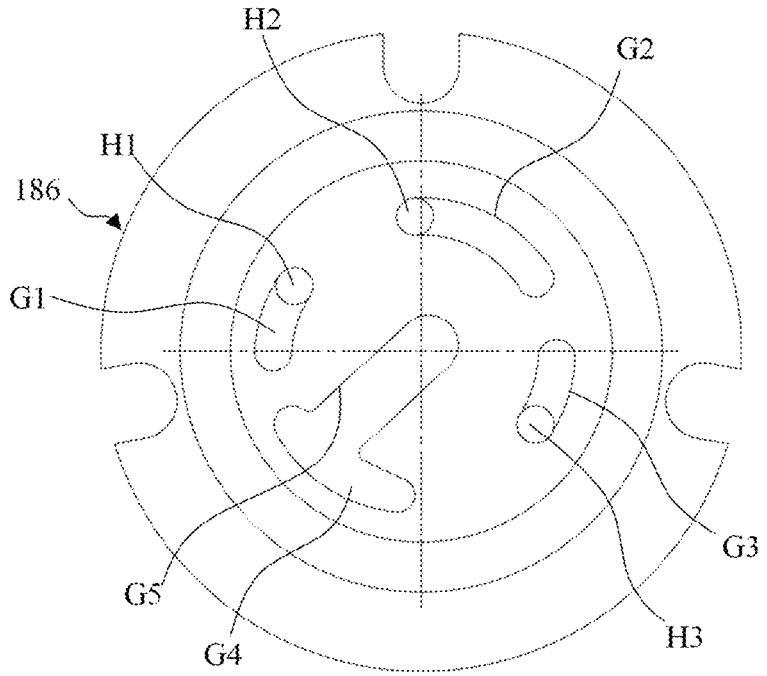
FIG. 11 is a schematic top view of the pump housing according to another embodiment of the present disclosure.
Figure 12:
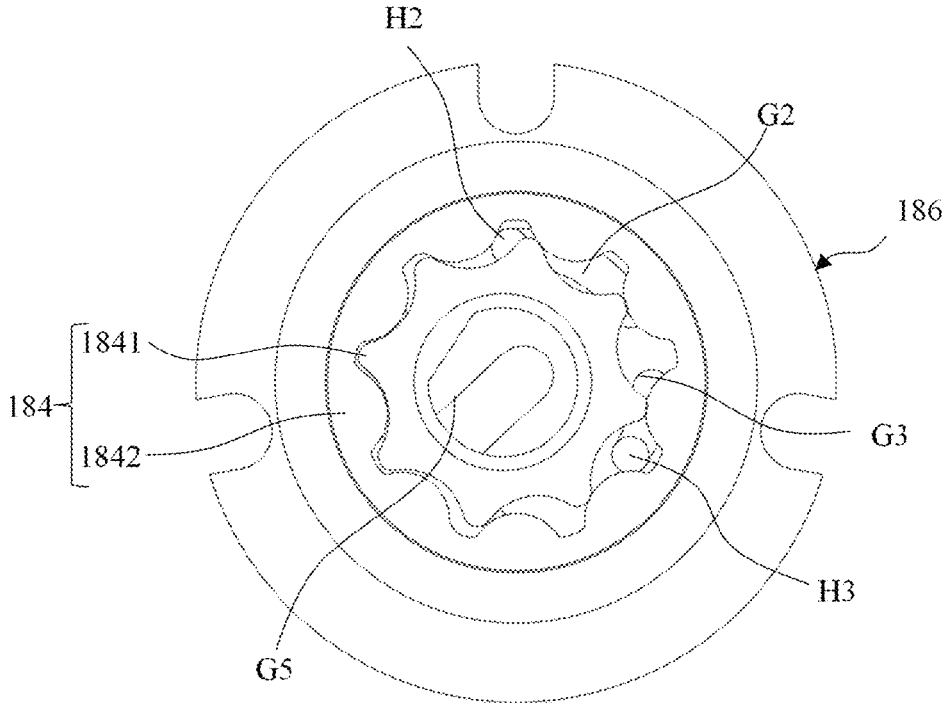
FIG. 12 is a schematic view showing the cooperation between the pump structure and the pump housing shown in FIG. 11 at a certain moment during operation, according to the present disclosure.
Figure 13A:
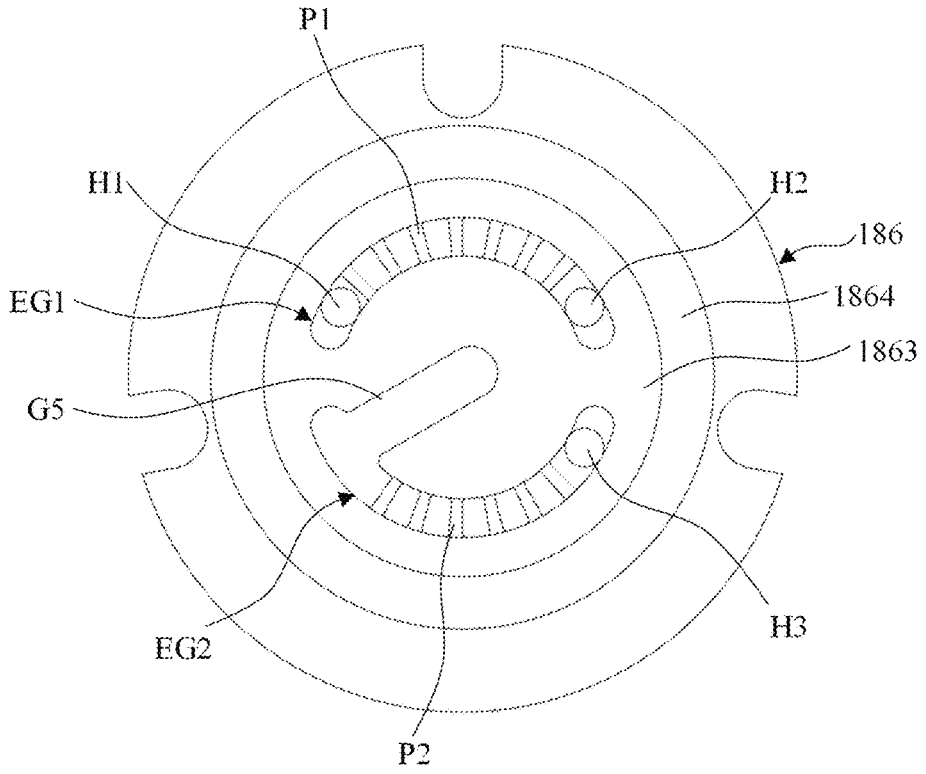
FIGS. 13A, 13B, and 13C respectively are the top view, perspective view and sectional view of the pump housing according to another embodiment of the present disclosure.
Figure 13B:
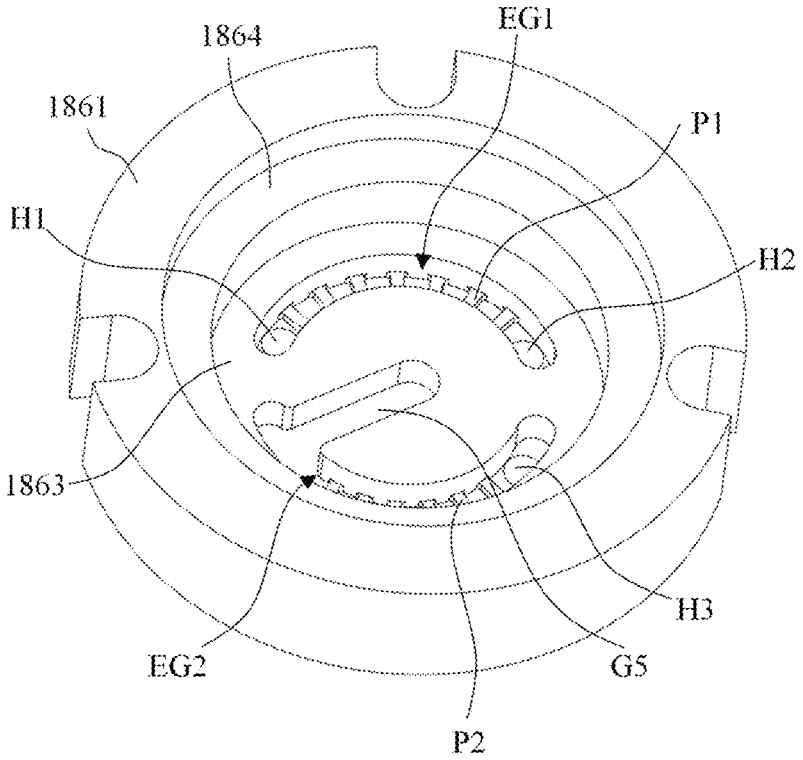
Figure 13C:
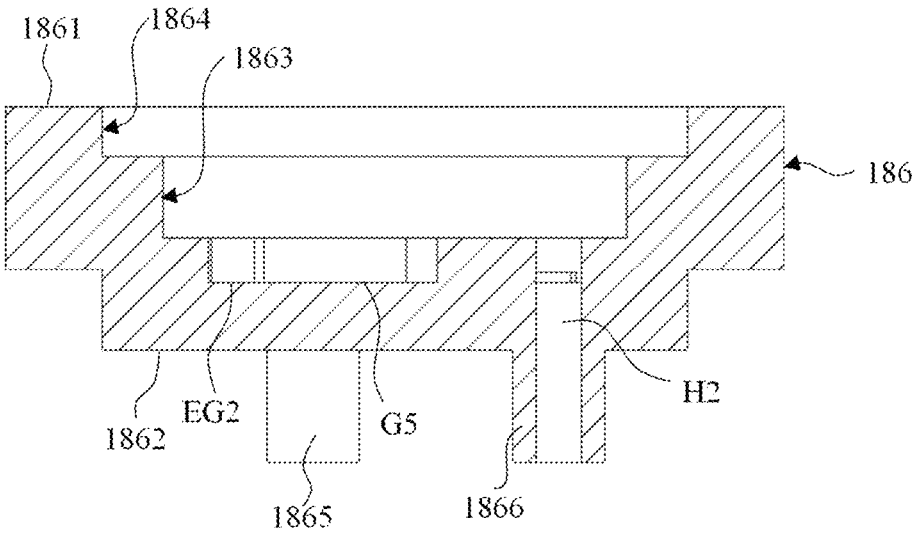

Optionally, as shown in FIGS. 8 and 11, the first blind groove G1, the second blind groove G2, the third blind groove G3 and the fourth blind groove G4 may be four arc-shaped grooves extending on a same circle on the bottom wall of the first recess 1863 of the pump housing 186. Optionally, as shown in FIG. 8, the lengths of the first blind groove G1, the second blind groove G2, the third blind groove G3 and the fourth blind groove G4 (that is, the length of the blind groove extending in a longitudinal direction of the blind groove) may be the same, and the four blind grooves may be in centrosymmetry with reference to each other. Optionally, as shown in FIGS. 11 and 12, the first blind groove G1, the second blind groove G2, the third blind groove G3 and the fourth blind groove G4 may have different lengths. Optionally, any two adjacent blind grooves of the first blind groove G1, the second blind groove G2, the third blind groove G3 and the fourth blind groove G4 may be spaced apart by the same or different distances (in a case that the four blind grooves are on the same circle, the distance may be the length of an arc on the circle).

In this way, by adjusting the length and/or position of the individual blind grooves, and by adjusting the size and/or position of the through hole in the individual blind grooves to accordingly adjust the oil suction volume and/or oil suction speed, oil discharge volume and/or oil discharge speed of the fluid pumping device, different application requirements can be met.

In the embodiment described above in conjunction with FIGS. 8 and 11, the first blind groove G1, the second blind groove G2, the third blind groove G3 and the fourth blind groove G4 are formed independently, and the position and size of each blind groove are unchanged. Optionally, the related structure can be appropriately modified, so that the related size can be adjusted according to actual application needs, thereby further enhancing the convenience and flexibility of application of the fluid pumping device. FIGS. 13A to 16B show examples of such embodiments.

In another embodiment according to the present disclosure as shown in FIGS. 13A to 16B, the first blind groove G1 and the second blind groove G2 are two different parts separated in the same groove. Similarly, the third blind groove G3 and the fourth blind groove G4 may be two different parts separated in the same groove. The partition assembly arranged in the groove can be used to realize the separation of different parts in the same groove, and the position of the partition assembly in the groove can be adjusted, so that the suction volume and discharge volume of the fluid pumping device can be adjusted according to the requirements of actual applications, thereby achieving different suction and discharge ratios.

As shown in FIGS. 13A to 15B, a suction side groove EG1 may be formed on the bottom wall of the first recess 1863 of the pump housing 186, and the suction side groove EG1 may be formed on a side of the bottom wall of the first recess 1863 corresponding to the suction pocket of the pump structure 184. As shown in FIGS. 13A to 15B, the suction side groove EG1 may be an arc-shaped groove with a large length (for example, extending in an angular range between 120 degrees to 160 degrees). The suction side groove EG1 may be provided with a position-adjustable first partition assembly, so that the suction side groove EG1 can be partitioned into the first blind groove G1 and the second blind groove G2 which are separated from each other by the first partition assembly, and the relative size of the first blind groove G1 and the second blind groove G2 can be adjusted by adjusting the position of the first partition assembly in the suction side groove EG1, so as to meet different application requirements.

In the specific embodiment as shown in FIGS. 13A to 15B, two or more first engaging protrusions P1 may be provided in the suction side groove EG1. The two or more first engaging protrusions P1 may be distributed on the bottom wall of the suction side groove EG1 at a predetermined interval. Optionally, in an embodiment not shown, multiple first engaging protrusions may be distributed on the bottom wall of the suction side groove in an irregular form.

Figure 16A:
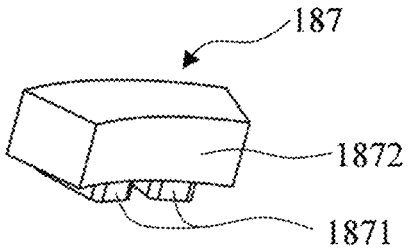
FIGS. 16A and 16B respectively are perspective views of a first engaging block and a second engaging block according to an embodiment of the present disclosure.
Figure 16B:
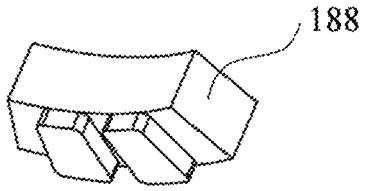

As shown in FIGS. 16A and 16B, a first engaging block 187 may be provided. The first engaging block 187 may include an engaging protrusion 1871 and a partition body 1872. The engaging protrusion 1871 may be engaged between two adjacent first engaging protrusions P1, and the partition body 1872 may divide the suction side groove EG1 into two separate parts, namely the first blind groove G1 and the second blind groove G2. There may be two or more engaging protrusions 1871, so that the first engaging block 187 can be more firmly engaged and connected between the corresponding first engaging protrusions P1 in the suction side groove EG1.

In this embodiment, the aforementioned first partition assembly is constituted by the first engaging protrusions P1 and the first engaging block 187. However, it can be understood that the first partition assembly may have other different configurations or forms. For example, multiple notches may be further provided in the suction side groove, and an insert block capable of being inserted into the notch and capable of partitioning the suction side groove may be provided. Alternatively, a configuration with a more complex structure may be envisaged, for example, a partition member is provided in the suction side groove, and position change of the partition member is realized by actuation from an external force, thereby realizing changes in the size of the first blind groove G1 and the second blind groove G2, and meeting actual requirements.

Similarly, a discharge side groove EG2 may be formed on the bottom wall of the first recess 1863 of the pump housing 186. The discharge side groove EG2 may be located on a side of the bottom wall of the first recess 1863 corresponding to the compression pocket of the pump structure 184. The discharge side groove EG2 may be opposite to the suction side groove EG1. The discharge side groove EG2 may have the same or different structure and form as or from the suction side groove EG1. In the embodiment shown in FIGS. 13A to 15B, the discharge side groove EG2 has the same structure and form as the suction side groove EG1, and will not be described in detail. In addition, the discharge side groove EG2 is in fluid communication with the aforementioned radial groove G5.

Similarly, the discharge side groove EG2 may be provided with a position-adjustable second partition assembly, so that the discharge side groove EG2 can be partitioned into the third blind groove G3 and the fourth blind groove G4 by the second partition assembly, and the relative size of the third blind groove G3 and the fourth blind groove G4 can be adjusted by adjusting the position of the second partition assembly in the discharge side groove EG2, so as to meet different application requirements.

Similar to the structure of the first partition assembly, the second partition assembly may include two or more second engaging protrusions P2 provided in the discharge side groove EG2 and a second engaging block 188 configured to be engaged with the two or more second engaging protrusions P2 to partition the discharge side groove EG2 into the third blind groove G3 and the fourth blind groove G4. It can be understood that, for the convenience of design, processing or the like, as shown in FIGS. 13A to 16B, the second engaging protrusion P2 may have the same structure and arrangement as the first engaging protrusion P1. Moreover, the second engaging block 188 may have the same structure form as the first engaging block 187. Optionally, according to actual needs, the second engaging protrusion P2 and the second engaging block 188 may have different structures and forms from the first engaging protrusion P1 and the first engaging block 187.

In the embodiment shown in FIGS. 13A to 15B, the first through hole H1 and the second through hole H2 may be respectively formed at two ends of the suction side groove EG1, and the third through hole H3 may be formed at an end of the discharge side groove EG2 close to the second through hole H2. Another end of the discharge side groove EG2 may be in fluid communication with the radial groove G5.

Figure 14A:
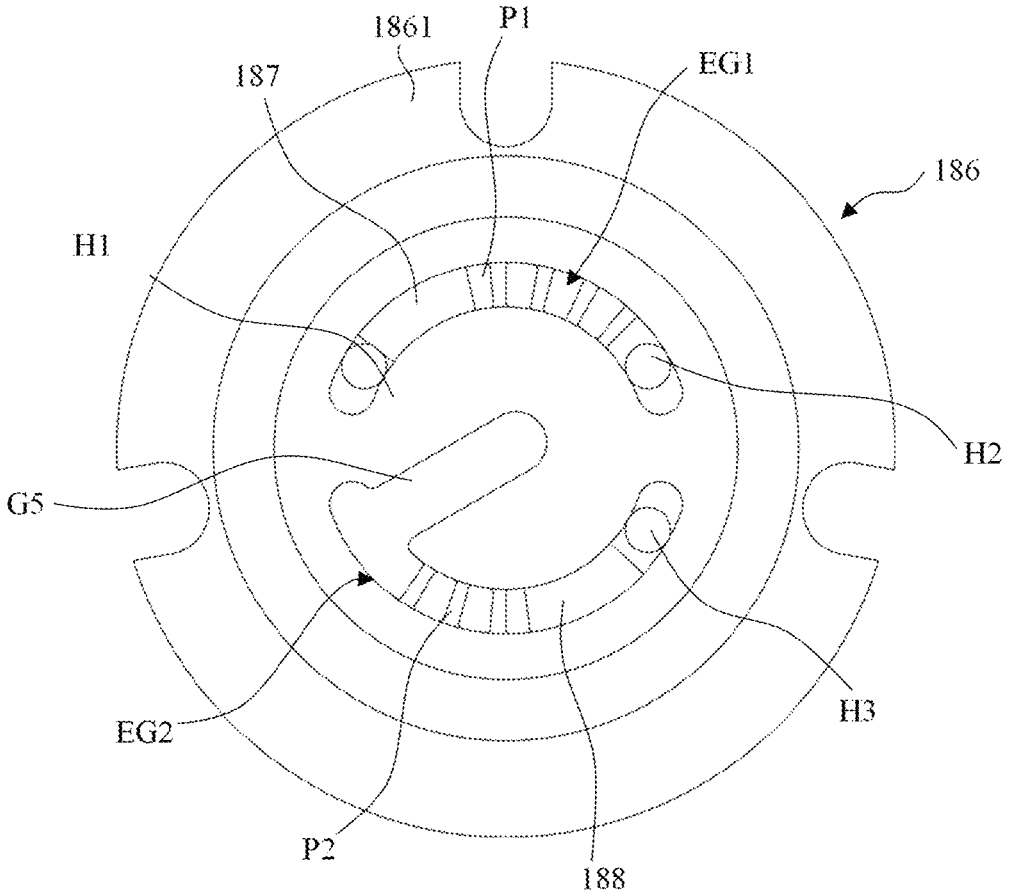
FIGS. 14A and 14B respectively are the plan view and perspective view showing a cooperation relationship between the pump housing and the corresponding engaging block shown in FIG. 13.
Figure 14B:
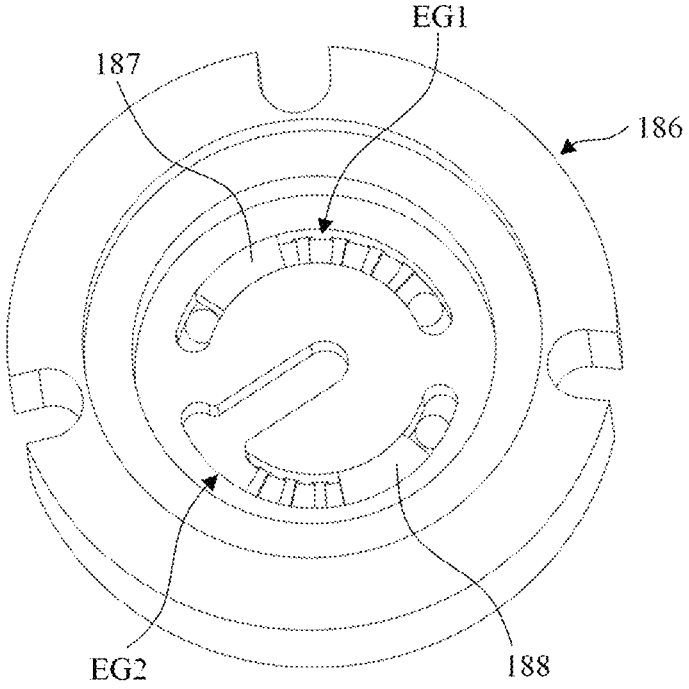
Figure 15A:
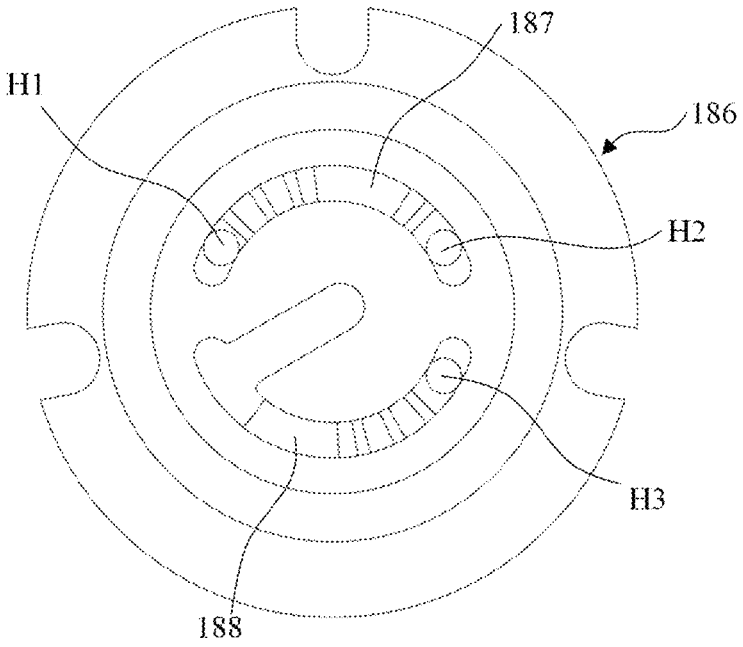
FIGS. 15A and 15B respectively are the plan view and perspective view showing another cooperation relationship between the pump housing and the corresponding engaging block shown in FIG. 13.
Figure 15B:
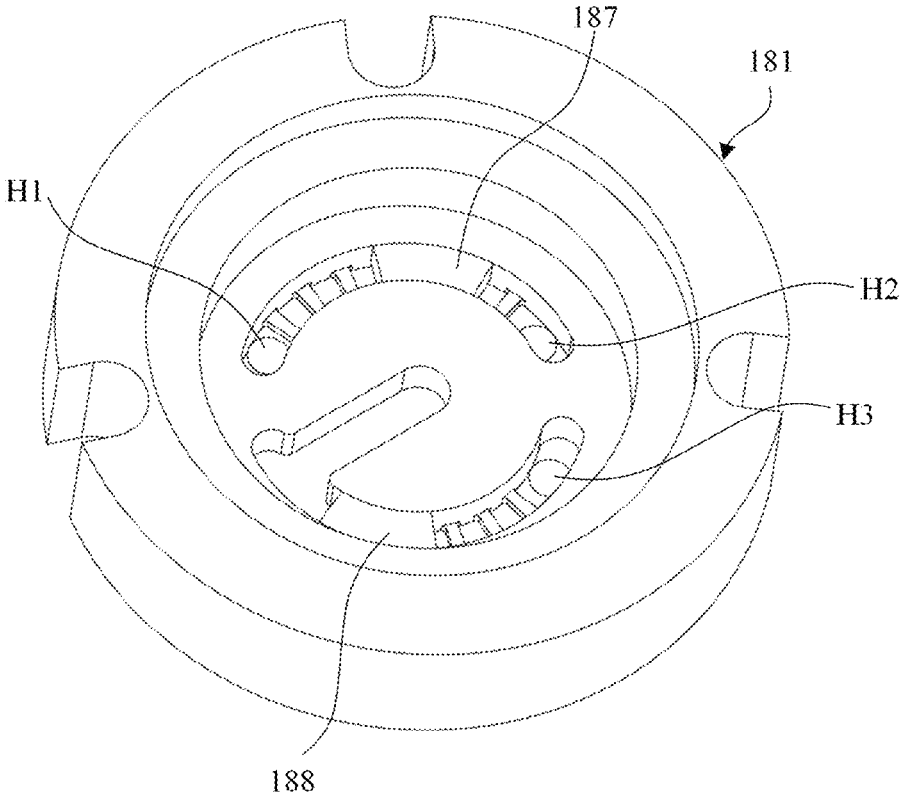

In the embodiment shown in FIGS. 14A and 14B, the first engaging block 187 and the second engaging block 188 are substantially opposite to each other. The first engaging block 187 is closer to the first through hole H1, and the second engaging block 188 is closer to the third through hole H3. FIGS. 15A and 15B show different arrangements, the first engaging block 187 is closer to the second through hole H2, and the second engaging block 188 is closer to the radial groove G5.

Therefore, by providing the adjustable partition assemblies such as the first partition assembly and the second partition assembly described above, it is convenient to make minor modifications to the partial structure of the existing fluid pumping device according to actual applications, thereby improving the applicability of the fluid pumping device according to the present disclosure and saving costs.

Advantageously, a protruding first pipe connecting portion 1865 may be formed at a position corresponding to the first through hole H1 on the second side surface 1862 of the pump housing 186, and a protruding second pipe connecting portion 1866 may be formed at a position corresponding to the second through hole H2 on the second side surface 1862 of the pump housing 186, so as to facilitate the connection of the external fluid pipeline to the fluid pumping device 180. It can be understood that the first through hole H1 may further extend through the first pipe connecting portion 1865, and the second through hole H2 may further extend through the second pipe connecting portion 1866. Advantageously, a protruding third pipe connecting portion 1867 may be formed at a position corresponding to the third through hole H3 on the second side surface 1862 of the pump housing 186, so as to guide the fluid in the corresponding compression pocket (that is, the first compression pocket PC1 in the embodiment illustrated in the present disclosure) out of the fluid pumping device 180 via the first discharge path. Similarly, the third through hole H3 may further extend through the third pipe connecting portion 1867.

It can be seen from the foregoing description that, in the fluid pumping device 180 according to the present disclosure, unlike the arrangement in which the third through hole H3 is provided in the third blind groove G3, the fourth blind groove G4 may be directly in fluid communication with the radial groove G5 without the need for additional through holes. With this structural design, the fluid compressed by the compression pockets PC1 and PC2 of the fluid pumping device 180 can be discharged from two sides of the fluid pumping device 180.

It should be noted here that in the above-mentioned exemplary embodiment, the first suction path may include the first blind groove G1 and the first through hole H1. It can be understood that, in the embodiment not shown, the first blind groove G1 may be omitted, that is, only the through hole penetrating through the bottom wall and the second side surface of the first recess of the pump housing is provided. Similarly, the second suction path may not include the second blind groove G2 but only include the through hole penetrating through the bottom wall and the second side surface of the first recess of the pump housing, and the first discharge path may not include the third blind groove G3 and only include the through hole penetrating through the bottom wall and the second side surface of the first recess of the pump housing.

The application of the fluid pumping device 180 according to the present disclosure in the horizontal compressor 100 and its related working process are further described with reference to FIGS. 1 to 16B.

In the application of the horizontal compressor 100 as shown in FIG. 1, the fluid pumping device 180 is located in the oil storage region SR in the horizontal compressor 100. As can be seen from the partial enlarged view of FIG. 2, when installed in place, the first gear member 1841 is sleeved and fixed on the D-shaped section end 1321 of the second end 132 of the rotating shaft 130. The sealing cover plate 182 is sleeved on the flange portion P of the first gear member 1841. The pump housing 186 is inserted and fixed in the receiving groove 152 of the rear end bearing housing 150. From the perspective of the plan view shown in FIG. 2, right sides of the D-shaped section end 1321, the first gear member 1841, and the second gear member 1842 abut against the bottom wall of the first recess 1863 of the pump housing 186. The first gear member 1841 and the second gear member 1842 abut against the sealing cover plate 182 on the left side. Suction pockets (only SC2 is shown in the figure) and compression pockets (only PC2 is shown in the figure) are formed between the first gear member 1841 and the second gear member 1842. It should be noted here that, in order to clearly show the relative positional relationship between the suction and compression pockets formed between the first gear member 1841 and the second gear member 1842 and the corresponding suction and discharge paths, the installation positions of the fluid pumping device 180 shown in FIG. 2 on the rotating shaft 130 and the rear end bearing housing 150 may be different from those shown in other views in the present disclosure.

Moreover, it can be seen that, in the state shown in FIG. 2, a concentric hole 134 in the rotating shaft 130 is in fluid communication with the radial groove G5, and can thereby be fluidly communicated to the fourth blind groove G4. Moreover, the second suction pocket SC2 is in fluid communication with the second blind groove G2 and the second through hole H2. Here, it can be understood that the length of the radial groove G5 on the bottom wall of the first recess 1863 of the pump housing 186 extending from the fourth blind groove toward the center of the first recess 1863 is configured such that the compressed fluid from the second compression pocket PC2 can be pumped into the concentric hole 134 of the rotating shaft 130 via the fourth blind groove and the radial groove G5. Preferably, the end position of the radial groove G5 extending from the fourth blind groove toward the center of the first recess 1863 should not exceed the coverage of the concentric hole 134 in the rotating shaft 130, so as to prevent part of the lubricating oil from leaking into the suction pockets and the suction path through the gap between the D-shaped section end 1321 of the rotating shaft 130 and the bottom wall of the first recess 1863 and through the gap between the first gear member 1841 and the bottom wall of the first recess 1863.

According to an embodiment of the present disclosure, in order to facilitate the suction of lubricating oil accumulated at the bottom of the horizontal compressor, a first fluid supply pipe LP1 and a second fluid supply pipe LP2 may be provided. The first fluid supply pipe LP1 may be connected to the first pipe connecting portion 1865 on the second side surface 1862 of the pump housing 186, and the second fluid supply pipe LP2 may be connected to the second pipe connecting portion 1866 on the second side surface 1862 of the pump housing 186.

The first fluid supply pipe LP1 and the second fluid supply pipe LP2 may be further extended to appropriate positions in the oil storage region SR and the motor region MR of the horizontal compressor 100 accordingly, so that lubricating oil can be sucked from the oil storage region SR and the motor region MR of the horizontal compressor 100. Preferably, the first fluid supply pipe LP1 may be extended to an appropriate position in the oil storage region SR of the horizontal compressor 100, and the second fluid supply pipe LP2 may be extended to an appropriate position in the motor region MR of the horizontal compressor 100. Therefore, during the operation of the horizontal compressor 100, the lubricating oil can be sucked from the oil storage region SR through the first fluid supply pipe LP1 and through the first suction path (that is, the first through hole H1 and the first blind groove G1), and the lubricating oil can also be sucked from the motor region MR through the second fluid supply pipe LP2 and through the second suction path (that is, the second through hole H2 and the second blind groove G2).

Advantageously, the first fluid supply pipe P1 may directly extend from the first pipe connecting portion 1865 to a position (to be specific, the second end cover 113 in the configuration shown in FIG. 1) having an appropriate distance from the bottom of the housing 110 in the oil storage area SR of the horizontal compressor, so as to facilitate the suction of lubricating oil from the oil storage region SR. The second fluid supply pipe LP2 may extend from the second pipe connecting portion 1866 and pass through the partition plate 160 to an appropriate position at the bottom of the motor region MR of the horizontal compressor, so as to suck the lubricating oil accumulated in the motor region MR of the horizontal compressor into the corresponding suction pocket. For example, as shown in FIG. 1, the second fluid supply pipe LP2 may first substantially extend vertically in the oil storage region SR of the horizontal compressor to a position close to the bottom of the second end cover 113, and then extend through the partition plate 160 approximately parallel to the bottom of the horizontal compressor 100 to an appropriate position in the motor region MR of the horizontal compressor 100.

According to the present disclosure, the compressed fluid in one of the compression pockets PC1 and PC2 of the fluid pumping device 180 can be discharged into the oil storage region SR of the horizontal compressor 100 through the corresponding discharge path, and the compressed fluid in the other compression pocket is supplied to the concentric hole 134 in the rotating shaft 130 via the corresponding discharge path. Preferably, the lubricating oil compressed by the first compression pocket PC1 may be discharged into the oil storage region SR of the horizontal compressor 100, and the lubricating oil compressed by the second compression pocket PC2 is supplied to the concentric hole 134 in the rotating shaft 130.

Since the third pipe connecting portion 1867 is located in the oil storage region SR of the horizontal compressor 100 and the lubricating oil discharged through the third pipe connecting portion 1867 may be directly discharged to the bottom of the oil storage region SR for storage, there is no need to provide additional fluid pipes connected to the third pipe connecting portion 1867. Optionally, the third pipe connecting portion 1867 may not be provided, and the compressed lubricating oil in the first compression pocket PC1 is directly discharged from the third through hole H3 to the oil storage region SR. Optionally, a third fluid pipe (not shown) may be provided at the third pipe connecting portion 1867, so as to better guide the compressed lubricating oil in the first compression pocket PC1 to the oil storage region SR.

According to the present disclosure, the lubricating oil compressed by the second compression pocket PC2 may be directly pumped into the concentric hole 134 of the rotating shaft 130 via the fourth blind groove G4 and the radial groove G5. It can be understood that, according to different applications, the structure of the pump housing can be modified accordingly to adapt to different application requirements. For example, the fourth discharge path may have the same structure as the third discharge path in order to supply the lubricating oil compressed by the second compression pocket PC2 to the corresponding components.

From the above description and in conjunction with FIGS. 1 to 10C, it can be known that, according to the present disclosure, preferably, the first fluid supply pipe LP1 can suck lubricating oil from the oil storage region SR of the horizontal compressor 100, and supply the lubricating oil into the first suction pocket SC1 through the first pipe connecting portion 1865, the first through hole H1 and the first blind groove G1; lubricating oil can be sucked from the motor region MR of the horizontal compressor 100 through the second fluid supply pipe LP1, and supplied into the second suction pocket SC2 through the second pipe connecting portion 1866, the second through hole H2 and the second blind groove G2. During the operation of the pump structure 184, the lubricating oil compressed by the first compression pocket PC1 can be discharged to the oil storage region SR of the horizontal compressor 100 through the third groove G3, the third through hole H3, and the third pipe connecting portion 1867; and the lubricating oil compressed by the second compression pocket PC2 can be pumped to the concentric hole 134 of the rotating shaft 130 via the fourth blind groove G4 and the radial groove G5, and be further provided to the corresponding moving components through the corresponding oil supply path in the rotating shaft 130.

This structural arrangement can bring about the following beneficial technical effects: after the horizontal compressor 100 is started, the lubricating oil can be sucked from the oil storage region SR firstly, which can avoid dry running (that is, running without lubricating oil) of related parts. As the horizontal compressor is operated, a certain amount of lubricating oil is accumulated in the motor region MR, and the lubricating oil can be sucked from the motor region MR via the second fluid supply pipe LP2 and the second suction path. Therefore, the lubricating oil accumulated in the motor area MR can be partially supplied to the oil storage region SR via the first discharge path and can be partly supplied to the rotating shaft. Thus, the lubricating oil accumulated in the motor region MR can be effectively used to realize a virtuous cycle of lubricating oil, and excessive supply of lubricating oil to various related movable components via the rotating shaft can be avoided. Moreover, with a single fluid pumping device, the lubricating oil can be sucked from the motor region and the oil storage region. Compared with the complicated configuration in the prior art (such as the combined dual pump structure), the structure is simplified, and the cost is reduced, and the convenience of application of the fluid pumping device is improved. In particular, through the above-mentioned structural configuration, even if there is a shortage of oil in the oil storage region SR at a moment when the horizontal compressor is started or at a certain (or some) moment during the operation of the horizontal compressor, it is still possible to provide lubricating oil to the rotating shaft from the motor region MR, which can improve the reliability and stability of the horizontal compressor and improve the applicability of the horizontal compressor. In addition, the first compression pocket PC1 is preferably communicated to the oil storage region SR, which helps to preferentially discharge the gas sucked into the suction pocket from the motor region to the oil storage region and avoid the gas from entering the rotating shaft. The stability of the operation of the fluid pumping device and the horizontal compressor can thus be improved.

While the various embodiments of the present disclosure have been described in detail herein, it is understood that the present disclosure is not limited to the specific embodiments described and illustrated herein in detail, and other variations and modifications can be made by the person skilled in the art without departing from the essence and scope of the present disclosure. For example, it is conceivable to control the opening and closing of the first discharge path through a separate valve member (for example, by means of a solenoid valve or other structure), so as to control the discharge of lubricating oil from the compression pocket to the oil storage region, for example, according to the rotation speed of the horizontal compressor. It can be understood that all the variations and modifications made on the basis of the present disclosure fall within the scope of the present disclosure. Moreover, all of the components described herein can be replaced by other technically equivalent components.

The invention claimed is:

1. A fluid pumping device for a horizontal compressor, comprising:

a pump structure comprising a first pump member and a second pump member which are configured to cooperate with each other, wherein the first pump member is arranged in the second pump member;

a pump housing structure defining a sealed pocket, wherein the pump structure is rotatably assembled in the sealed pocket, and a suction pocket and a compression pocket are defined between the first pump member and the second pump member;

a first suction path through which lubricating oil in a first oil source is sucked into the pump structure;

a second suction path through which lubricating oil in a second oil source is sucked into the pump structure;

a first discharge path through which lubricating oil is discharged from the pump structure into the first oil source; and a second discharge path through which lubricating oil is discharged from the pump structure into an oil supply passage of a rotating shaft of the horizontal compressor.

2. The fluid pumping device according to claim 1, wherein the pump housing structure comprises a pump housing having a first side surface and a second side surface opposite to each other, a first recess is provided on the first side surface of the pump housing, and the pump structure is installed in the first recess.

3. The fluid pumping device according to claim 2, wherein a second recess is provided on the first side surface of the pump housing and has a larger diameter than the first recess so that a transition stepped portion is formed between the first recess and the second recess, and the pump housing structure further comprises a sealing cover plate installed in the second recess at the first side surface of the pump housing such as to closely abut against the transition stepped portion and the pump structure.

4. The fluid pumping device according to claim 2, wherein the fluid pumping device has a first suction pocket and a second suction pocket formed between the first pump member and the second pump member, and the first suction path is in fluid communication with the first suction pocket and the second suction path is in fluid communication with the second suction pocket, the first suction path comprises a first blind groove provided on a bottom wall of the first recess of the pump housing and a first through hole extending through part of the bottom wall of the first blind groove to the second side surface;

the second suction path comprises a second blind groove provided on the bottom wall of the first recess of the pump housing and a second through hole extending through part of the bottom wall of the second blind groove to the second side surface; and the first blind groove and the second blind groove are sequentially arranged along a rotation direction of the pump structure on the bottom wall of the first recess and correspond to the suction pocket of the pump structure.

5. The fluid pumping device according to claim 4, wherein the fluid pumping device has a first compression pocket and a second compression pocket formed between the first pump member and the second pump member, and the first discharge path is in fluid communication with the first compression pocket and the second discharge path is in fluid communication with the second compression pocket, the first discharge path comprises a third blind groove provided on the bottom wall of the first recess of the pump housing and a third through hole extending through part of the bottom wall of the third blind groove to the second side surface;

the second discharge path comprises a fourth blind groove provided on the bottom wall of the first recess of the pump housing and a radial groove extending radially from the fourth blind groove toward the center of the first recess and being in fluid communication with the fourth blind groove; and the third blind groove and the fourth blind groove are sequentially arranged along the rotation direction of the pump structure on the bottom wall of the first recess and correspond to the first and second compression pockets of the pump structure.

6. The fluid pumping device according to claim 5, wherein the first blind groove, the second blind groove, the third blind groove and the fourth blind groove are four arc-shaped grooves extending on a same circle on the bottom wall of the first recess of the pump housing.

7. The fluid pumping device according to claim 6, wherein the first blind groove, the second blind groove, the third blind groove and the fourth blind groove have the same length and are arranged symmetrically with respect to the center of the first recess; or, the first blind groove, the second blind groove, the third blind groove and the fourth blind groove have different lengths, and/or two adjacent blind grooves of the first blind groove, the second blind groove, the third blind groove and the fourth blind groove are spaced apart by same or different distances.

8. The fluid pumping device according to claim 5, wherein a discharge side groove is formed on the bottom wall of the first recess of the pump housing and corresponds to the first compression pocket and the second compression pocket of the pump structure; and a second partition assembly is provided in the discharge side groove to partition the discharge side groove into the third blind groove and the fourth blind groove, and the second partition assembly is configured to adjust relative extension lengths of the third blind groove and the fourth blind groove by changing a position of the second partition assembly in the discharge side groove.

9. The fluid pumping device according to claim 8, wherein the second partition assembly comprises:

two or more second engaging protrusions arranged in the discharge side groove, and a second engaging block configured to be fixedly connected with the second engaging protrusions in a snap-fitting manner to partition the discharge side groove into the third blind groove and the fourth blind groove.

10. The fluid pumping device according to claim 5, wherein a first pipe connecting portion is formed on and protrudes from the second side surface of the pump housing at a position corresponding to the first through hole, and the first through hole further extends through the first pipe connecting portion; and/or, a second pipe connecting portion is formed on and protrudes from the second side surface of the pump housing at a position corresponding to the second through hole, and the second through hole further extends through the second pipe connecting portion; and/or, a third pipe connecting portion is formed on and protrudes from the second side surface of the pump housing at a position corresponding to the third through hole, and the third through hole further extends through the third pipe connecting portion.

11. The fluid pumping device according to claim 4, wherein a suction side groove is formed on the bottom wall of the first recess of the pump housing and corresponds to the first suction pocket and the second suction pocket of the pump structure; and a first partition assembly is provided in the suction side groove to partition the suction side groove into the first blind groove and the second blind groove, and the first partition assembly is configured to adjust relative extension lengths of the first blind groove and the second blind groove by changing a position of the first partition assembly in the suction side groove.

12. The fluid pumping device according to claim 11, wherein the first partition assembly comprises:

two or more first engaging protrusions arranged in the suction side groove, and a first engaging block configured to be fixedly connected with the first engaging protrusions in a snap-fitting manner to partition the suction side groove into the first blind groove and the second blind groove.

13. The fluid pumping device according to claim 1, wherein the pump structure is implemented as an inner-meshing gear pump and comprises an internal gear member as the first pump member and an external gear member as the second pump member.

14. A horizontal compressor, comprising:

a housing which is partitioned into a motor region comprising a motor and an oil storage region for storing lubricating oil;

a rotating shaft which is arranged in the housing and driven by the motor, wherein an oil supply passage is provided in and extends through the rotating shaft;

a compression mechanism which is arranged at a first end of the rotating shaft in the motor region, wherein lubricating oil can be supplied to the compression mechanism through the oil supply passage of the rotating shaft; and the fluid pumping device according to claim 1.

15. The horizontal compressor according to claim 14, wherein the fluid pumping device is installed at a second end of the rotating shaft in the oil storage region, and is configured to suck lubricating oil from the oil storage region and the motor region through the first suction path and the second suction path of the at least two suction paths respectively, and to pump the compressed lubricating oil to the oil storage region and the oil supply passage of the rotating shaft through the first discharge path and the second discharge path of the at least two discharge paths respectively.

16. The horizontal compressor according to claim 15, wherein the horizontal compressor further comprises a first fluid supply pipe for introducing the lubricating oil in the oil storage region into the first suction path and a second fluid supply pipe for introducing the lubricating oil accumulated in the motor region into the second suction path.

17. The horizontal compressor according to claim 16, wherein the first pump member of the fluid pumping device is fixedly installed on the second end of the rotating shaft, such that the radial groove in the first recess of the pump housing of the pump housing structure is aligned with the oil supply passage of the rotating shaft.

18. The horizontal compressor according to claim 17, further comprising:

a partition plate fixed to the housing in the housing and dividing the inside of the housing into the motor region and the oil storage region; and a rear end bearing housing, wherein the partition plate is mounted on the rear end bearing housing, and the rear end bearing housing is configured to support the second end of the rotating shaft, and the pump housing of the fluid pumping device is fixedly connected to the rear end bearing housing.

* * * * *